US012225931B2

(12) United States Patent
Biel et al.

(10) Patent No.: US 12,225,931 B2
(45) **Date of Patent: *Feb. 18, 2025**

(54) ELECTRONIC SMOKING DEVICE WITH REFILLABLE LIQUID RESERVOIR

(71) Applicant: Fontem Ventures B.V., Amsterdam (NL)

(72) Inventors: Stefan Biel, Hamburd (DE); Andreas Beer, Grasbrunn (DE)

(73) Assignee: Fontem Ventures B.V., Amsterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 18/092,796

(22) Filed: Jan. 3, 2023

(65) Prior Publication Data

US 2023/0354907 A1 Nov. 9, 2023

Related U.S. Application Data

(63) Continuation of application No. 16/330,042, filed as application No. PCT/EP2017/072321 on Sep. 6, 2017, now Pat. No. 11,571,024.

(30) Foreign Application Priority Data

Sep. 6, 2016 (EP) ..... 16187508
Sep. 14, 2016 (EP) ..... 16188830

(51) Int. Cl.
*A24F 40/10* (2020.01)
*A24F 15/015* (2020.01)
(Continued)

(52) U.S. Cl.
CPC ..... *A24F 15/015* (2020.01); *A24F 40/42* (2020.01); *A24F 40/485* (2020.01); *A24F 40/95* (2020.01); *A24F 40/10* (2020.01)

(58) Field of Classification Search
None
See application file for complete search history.

(56) References Cited

U.S. PATENT DOCUMENTS

2013/0192618 A1 8/2013 Li et al.
2015/0282530 A1 10/2015 Johnson et al.
(Continued)

FOREIGN PATENT DOCUMENTS

CN 1625443 A 6/2005
CN 201061259 Y 5/2008
(Continued)

*Primary Examiner* — Cynthia Szewczyk
(74) *Attorney, Agent, or Firm* — Dykema Gossett PLLC

(57) ABSTRACT

An electronic smoking device (10) includes a power supply portion (12) comprising a power supply (18) as well as an atomizer/liquid reservoir portion (14) comprising a refillable liquid reservoir (34) adapted for storing a liquid, and an atomizer (26) operable when connected to the power supply (18) to atomize liquid stored in the liquid reservoir (34). The atomizer/liquid reservoir portion (14) comprises a liquid filling channel (40) and an air outlet channel (42) at least partially separate from the liquid filling channel (40). The liquid filling channel (40) communicates with the liquid reservoir (34) and is configured to let pass liquid received from outside the electronic smoking device (10) into the liquid reservoir (34). The air outlet channel (42) communicates with the liquid reservoir (34) and is configured to let pass air out of the liquid reservoir (34).

15 Claims, 16 Drawing Sheets

(51) Int. Cl.

| | |
|---|---|
| ***A24F 40/42*** | (2020.01) |
| ***A24F 40/485*** | (2020.01) |
| ***A24F 40/95*** | (2020.01) |

(56) References Cited

U.S. PATENT DOCUMENTS

| | | | | |
|---|---|---|---|---|
| 2016/0095355 | A1* | 4/2016 | Hearn ..... | A24F 40/485<br>131/273 |
| 2016/0128384 | A1 | 5/2016 | Luciani | |
| 2017/0013880 | A1 | 1/2017 | O'Brien et al. | |

FOREIGN PATENT DOCUMENTS

| | | | |
|---|---|---|---|
| CN | 203860453 | U | 10/2014 |
| CN | 104780795 | A | 7/2015 |
| CN | 204682530 | U | 10/2015 |
| CN | 105050919 | A | 11/2015 |
| CN | 204861163 | U | 12/2015 |
| CN | 204994614 | U | 1/2016 |
| CN | 105392377 | A | 3/2016 |
| CN | 205196999 | U | 5/2016 |
| CN | 105795521 | A | 7/2016 |
| CN | 205358217 | U | 7/2016 |
| WO | 2014195859 | A2 | 12/2014 |
| WO | 2016128717 | A1 | 8/2016 |

* cited by examiner

ELECTRONIC SMOKING DEVICE WITH REFILLABLE LIQUID RESERVOIR

CROSS-REFERENCE TO RELATED APPLICATIONS

This application is a continuation of U.S. application Ser. No. 16/330,042, filed 1 Mar. 2019 (the '042 application), which is a national stage filing based upon international application no. PCT/EP2017/072321, filed 6 Sep. 2017 and published in English on 15 Mar. 2018 under international publication no. WO 2018/046530 (the '321 application), which claims priority to European application no. 16188830.0, filed 14 Sep. 2016 (the '830 application) and claims priority to European application no. 16187508.3, filed 6 Sep. 2016 (the '508 application). The '042 application, the '321 application, the '830 application and the '508 application are all hereby incorporated by reference in their entirety as though fully set forth herein.

FIELD OF INVENTION

The present invention relates generally to electronic smoking devices and in particular electronic cigarettes. The present invention in particular relates to electronic smoking devices having a refillable liquid reservoir.

BACKGROUND OF THE INVENTION

An electronic smoking device, such as an electronic cigarette (e-cigarette), typically has a housing accommodating an electric power source (e.g. a single use or rechargeable battery, electrical plug, or other power source), and an electrically operable atomizer. The atomizer vaporizes or atomizes liquid supplied from a liquid reservoir and provides vaporized or atomized liquid as an aerosol. Control electronics control the activation of the atomizer. In some electronic cigarettes, an airflow sensor is provided within the electronic smoking device, which detects a user puffing on the device (e.g., by sensing an under-pressure or an air flow pattern through the device). The airflow sensor indicates or signals the puff to the control electronics to power up the device and generate vapor. In other e-cigarettes, a switch is used to power up the e-cigarette to generate a puff of vapor.

An electronic smoking device can be adapted to allow refilling a liquid reservoir.

SUMMARY OF THE INVENTION

In accordance with one aspect of the present invention there is provided an electronic smoking device including a power supply portion comprising a power supply as well as an atomizer/liquid reservoir portion comprising a refillable liquid reservoir adapted for storing a liquid, and an atomizer operable when connected to the power supply to atomize liquid stored in the liquid reservoir. The atomizer/liquid reservoir portion comprises a liquid filling channel and an air outlet channel at least partially separate from the liquid filling channel. The liquid filling channel communicates with the liquid reservoir and is configured to let pass liquid received from outside the electronic smoking device into the liquid reservoir. The air outlet channel communicates with the liquid reservoir and is configured to let pass air out of the liquid reservoir.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views:

FIG. 7B is a schematic cross-sectional partial view of the atomizer/liquid reservoir portion of FIG. 7A, wherein a mouthpiece is coupled to the base portion, while the refill adapter portion has been removed;

DESCRIPTION OF THE PREFERRED EMBODIMENTS

Figure 1:
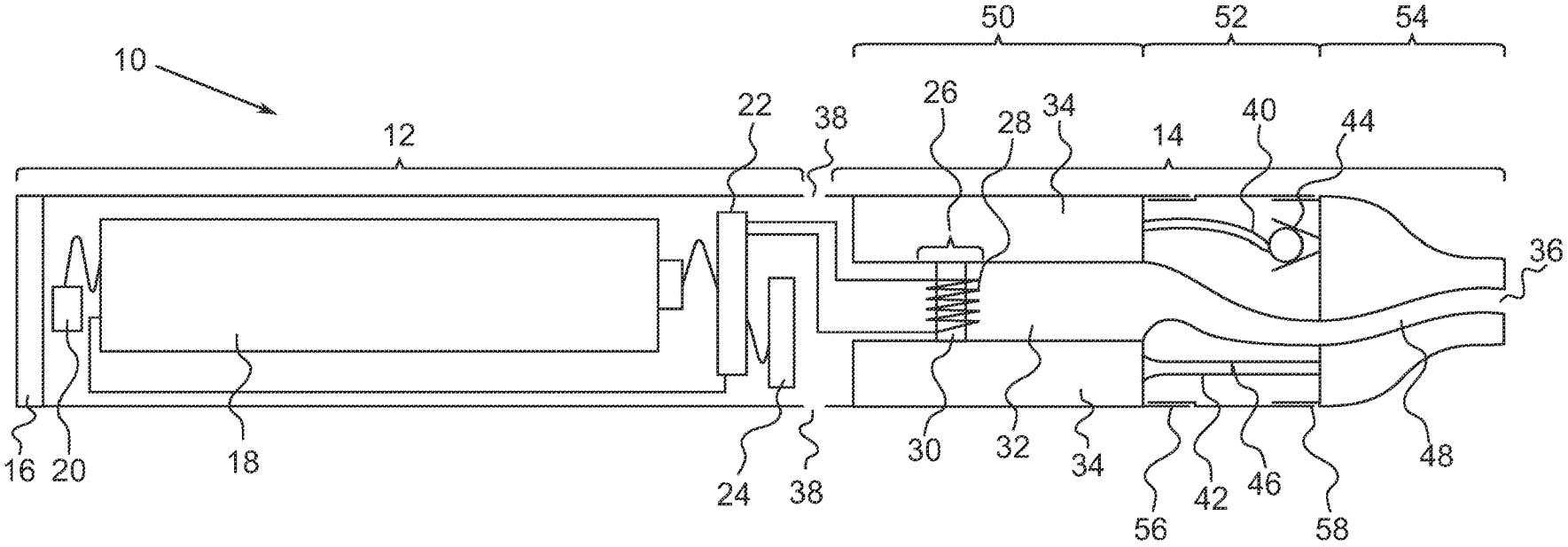
FIG. 1 is a schematic cross-sectional illustration of an exemplary e-cigarette.

Throughout the following, an electronic smoking device will be exemplarily described with reference to an e-cigarette. As is shown in FIG. 1, an e-cigarette 10 typically has a housing comprising a cylindrical hollow tube having an end cap 16. The cylindrical hollow tube may be a single-piece or a multiple-piece tube. In FIG. 1, the cylindrical hollow tube is shown as a two-piece structure having a power supply portion 12 and an atomizer/liquid reservoir portion 14. As indicated in FIG. 1 and to be described in more detail below, the atomizer/liquid reservoir portion 14 can in turn be subdivided to a plurality of portions, such as a base portion 50 including the liquid reservoir and the atomizer, a refill adapter portion 52, and a mouthpiece 54. The base portion and the refill adapter portion may also be integrally formed in one portion.

Together the power supply portion 12 and the atomizer/liquid reservoir portion 14 form a cylindrical tube which can be approximately the same size and shape as a conventional cigarette, typically about 100 mm with a 7.5 mm diameter, although lengths may range from 70 to 150 or 180 mm, and diameters from 5 to 28 mm.

The power supply portion 12 and atomizer/liquid reservoir portion 14 are typically made of metal, e.g. steel or aluminum, or of hardwearing plastic and act together with the end cap 16 to provide a housing to contain the components of the e-cigarette 10. The power supply portion 12 and an atomizer/liquid reservoir portion 14 may be configured to fit together by a friction push fit, a snap fit, or a bayonet attachment, magnetic fit, or screw threads. In an analog manner, as described below in more detail, respective coupling portions 56 and 58 can be provided in order to fit together the base portion 50 and the refill adapter portion 52, and the refill adapter portion and the mouthpiece, respectively.

The end cap 16 is provided at the front end of the power supply portion 12. The end cap 16 may be made from translucent plastic or other translucent material to allow a light-emitting diode (LED) 20 positioned near the end cap to emit light through the end cap. The end cap can be made of metal or other materials that do not allow light to pass.

An air inlet may be provided in the end cap, at the edge of the inlet next to the cylindrical hollow tube, anywhere along the length of the cylindrical hollow tube, or at the connection of the power supply portion 12 and the atomizer/liquid reservoir portion 14. FIG. 1 shows a pair of air inlets 38 provided at the intersection between the power supply portion 12 and the atomizer/liquid reservoir portion 14.

A power supply, preferably a battery 18, an LED 20, control electronics 22 and optionally an airflow sensor 24 are provided within the cylindrical hollow tube power supply portion 12. The battery 18 is electrically connected to the control electronics 22, which are electrically connected to the LED 20 and the airflow sensor 24. In this example the LED 20 is at the front end of the power supply portion 12, adjacent to the end cap 16 and the control electronics 22 and airflow sensor 24 are provided in the central cavity at the other end of the battery 18 adjacent the atomizer/liquid reservoir portion 14.

The airflow sensor 24 acts as a puff detector, detecting a user puffing or sucking on the atomizer/liquid reservoir portion 14 of the e-cigarette 10. The airflow sensor 24 can be any suitable sensor for detecting changes in airflow or air pressure, such as a microphone switch including a deformable membrane which is caused to move by variations in air pressure. Alternatively, the sensor may be a Hall element or an electro-mechanical sensor.

The control electronics 22 are also connected to an atomizer 26. In the example shown, the atomizer 26 includes a heating coil 28 which is wrapped around a wick 30 extending across a central passage 32 of the atomizer/liquid reservoir portion 14. The coil 28 may be positioned anywhere in the atomizer 26 and may be transverse or parallel to the liquid reservoir 34. The wick 30 and heating coil 28 do not completely block the central passage 32. Rather an air gap is provided on either side of the heating coil 28 enabling air to flow past the heating coil 28 and the wick 30. The atomizer may alternatively use other forms of heating elements, such as ceramic heaters, or fiber or mesh material heaters. Nonresistance heating elements such as sonic, piezo and jet spray may also be used in the atomizer in place of the heating coil.

The central passage 32 is surrounded by a cylindrical liquid reservoir 34 with the ends of the wick 30 abutting or extending into the liquid reservoir 34. The wick 30 may be a porous material such as a bundle of fiberglass fibers, with liquid in the liquid reservoir 34 drawn by capillary action from the ends of the wick 30 towards the central portion of the wick 30 encircled by the heating coil 28.

The liquid reservoir 34 may alternatively include wadding soaked in liquid which encircles the central passage 32 with the ends of the wick 30 abutting the wadding. In other embodiments the liquid reservoir 34 may comprise a toroidal cavity arranged to be filled with liquid and with the ends of the wick 30 extending into the toroidal cavity.

An air inhalation port 36 is provided at the back end of the atomizer/liquid reservoir portion 14 remote from the end cap 16. The inhalation port 36 may be formed from the cylindrical hollow tube atomizer/liquid reservoir portion 14 or maybe formed in a mouthpiece 54, as shown in FIG. 1.

In use, a user sucks on the e-cigarette 10. This causes air to be drawn into the e-cigarette 10 via one or more air inlets, such as air inlets 38, and to be drawn through the central passage 32 and a vapor channel 48 towards the air inhalation port 36. The change in air pressure which arises is detected by the airflow sensor 24, which generates an electrical signal that is passed to the control electronics 22. In response to the signal, the control electronics 22 activate the heating coil 28, which causes liquid present in the wick 30 to be vaporized creating an aerosol (which may comprise gaseous and liquid components) within the central passage 32. As the user continues to suck on the e-cigarette 10, this aerosol is drawn through the central passage 32 and the vapor channel 48 and is inhaled by the user. At the same time the control electronics 22 also activate the LED 20 causing the LED 20 to light up which is visible via the translucent end cap 16 mimicking the appearance of a glowing ember at the end of a conventional cigarette. As liquid present in the wick 30 is converted into an aerosol more liquid is drawn into the wick 30 from the liquid reservoir 34 by capillary action and thus is available to be converted into an aerosol through subsequent activation of the heating coil 28.

Some e-cigarette are intended to be disposable and the electric power in the battery 18 is intended to be sufficient to vaporize the liquid contained within the liquid reservoir 34, after which the e-cigarette 10 is thrown away. In other embodiments the battery 18 is rechargeable and the liquid reservoir 34 is refillable. In the cases where the liquid reservoir 34 is a toroidal cavity, this may be achieved by refilling the liquid reservoir 34 via a liquid filling channel 40. The liquid filling channel 40 communicates with the liquid reservoir 34 and is configured to let pass liquid received from outside the electronic smoking device, e.g. from a liquid container, into the liquid reservoir. The electronic cigarette 10 further includes an air outlet channel 42 separate from the liquid filling channel 40. The air outlet channel 42 also communicates with the liquid reservoir 34 and is configured to let pass air out of the liquid reservoir 34, e.g. in case of overpressure inside the liquid reservoir 34, when the liquid reservoir 34 is filled with liquid.

The electronic cigarette 10 further comprises a check valve 44 communicating with the liquid filling channel 40. The check valve 44 is configured to let pass liquid received from the outside of the electronic smoking device 10 through the liquid filling channel 40 to the liquid reservoir 34 and to prevent liquid from leaking form the liquid reservoir 34 through the liquid filling channel 40. Different types of check valves can be used, as described in more detail below, such as an umbrella valve, a duck bill valve, or a ball valve. There are embodiments, however, where the check valve 44 is dispensable, as described below.

The electronic cigarette 10 further includes a vent 46 communicating with the air outlet channel 42. The vent 46, which can e.g. be formed by a suitable membrane, is configured to let pass air from the liquid reservoir 34 through the air outlet channel 42 and to prevent liquid from leaking from the liquid reservoir 34 through the air outlet channel 42. In some embodiments, the vent is not necessary, as described below.

In order to prevent liquid from entering the vapor channel 48, the vapor channel 48 and the liquid filling channel 40 are separated.

In other embodiments the atomizer/liquid reservoir portion 14 of the e-cigarette 10 is detachable from the power supply portion 12 and a new atomizer/liquid reservoir portion 14 can be fitted with a new liquid reservoir 34 thereby replenishing the supply of liquid. In some cases, replacing the liquid reservoir 34 may involve replacement of the heating coil 28 and the wick 30 along with the replacement of the liquid reservoir 34. A replaceable unit comprising the atomizer 26 and the liquid reservoir 34 is called a cartomizer.

The new liquid reservoir 34 may be in the form of a cartridge having a central passage 32 through which a user inhales aerosol. In other embodiments, aerosol may flow around the exterior of the cartridge 32 to an air inhalation port 36.

Of course, in addition to the above description of the structure and function of a typical e-cigarette 10, variations also exist. For example, the LED 20 may be omitted. The airflow sensor 24 may be placed adjacent the end cap 16 rather than in the middle of the e-cigarette. The airflow sensor 24 may be replaced with a switch which enables a user to activate the e-cigarette manually rather than in response to the detection of a change in air flow or air pressure.

Different types of atomizers may be used. Thus, for example, the atomizer may have a heating coil in a cavity in the interior of a porous body soaked in liquid. In this design aerosol is generated by evaporating the liquid within the porous body either by activation of the coil heating the porous body or alternatively by the heated air passing over or through the porous body. Alternatively, the atomizer may use a piezoelectric atomizer to create an aerosol either in combination or in the absence of a heater.

Figure 2:
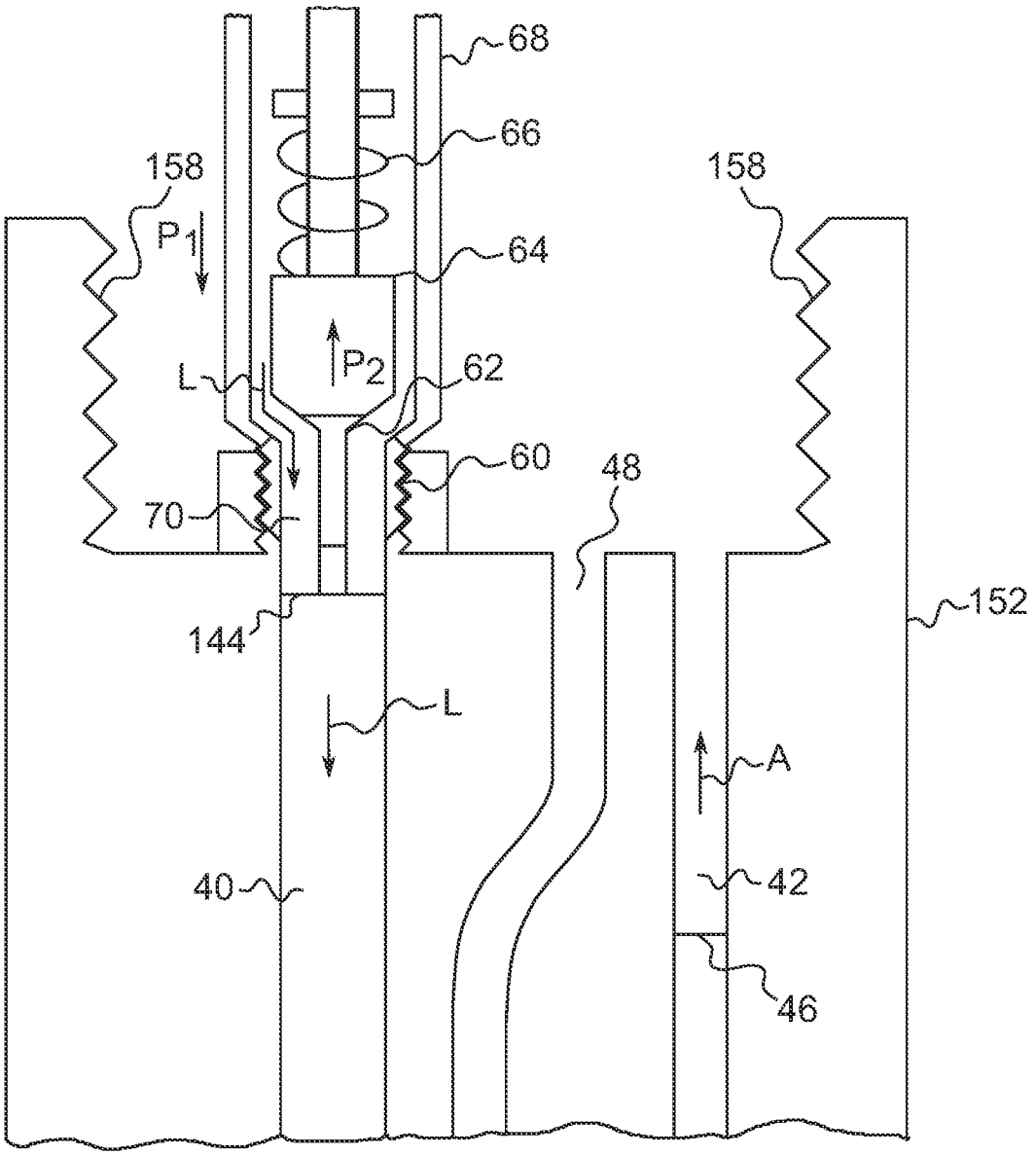
FIG. 2 is a schematic cross-sectional view illustrating coupling a liquid container to a liquid container coupling portion of an electronic cigarette according to a first embodiment.

FIG. 2 is a schematic cross-sectional view illustrating coupling a liquid container 68 to a liquid container coupling portion 60 of an electronic cigarette according to a first embodiment.

In FIG. 2, only the relevant portion of a refill adapter portion 152 is shown. As generally described with reference to FIG. 1, the refill adapter portion 152 together with a base portion (not shown in FIG. 2) form part of the atomizer/liquid reservoir portion 14. A mouthpiece coupling portion 158, which in the example forms part of the screw joint, is provided in order to recouple the mouthpiece to the atomizer/liquid reservoir portion once the liquid reservoir 34 has been refilled. In general, the mouthpiece is temporarily removed from the electronic cigarette when the liquid reservoir is refilled. However, there are embodiments (not shown in this document) in which the liquid reservoir can be refilled without removing a mouthpiece, e.g. in case a liquid container coupling portion is provided on outer surface of the atomizer/liquid reservoir portion.

The refill adapter portion 152 includes a liquid container coupling portion 60 that is configured to engage with a respective coupling portion of a liquid container 68 so as to couple the liquid container 68 with the atomizer/liquid reservoir portion 14, in particular with the refill adapter portion 152, in order to refill the liquid reservoir 34 with liquid included in the liquid container 68. The liquid container coupling portion 60 in FIG. 2 forms part of a screw joint. According to alternative embodiments, some of which are described below, the liquid container coupling may form part of a bayonet fitting (cf. FIG. 3), a plug connection, or any other type of suitable releasable connection.

In FIG. 2, only a tip portion of the liquid container 68 is shown, which liquid container 68 can e.g. be formed as a bottle or any other type of suitable receptacle. The liquid container can be squeezable in order to enhance supplying liquid to the liquid reservoir of the electronic cigarette. However, liquid can also be supplied by means of gravity draining, i.e. without applying additional pressure.

The tip portion of the liquid container 68 is configured to engage with the liquid container coupling portion 60, i.e. outer surface of the tip portion is suitably threaded. In the inside, the tip portion of the liquid container 68 includes a specific type of valve which allows liquid entering the liquid filling channel 40 when the valve element 64, which normally prevents liquid from leaking form the liquid container, is dislocated in direction of the arrow $P_2$ against a preload, e.g. a spring 66, by abutting against the contacting element 62 of the atomizer/liquid reservoir portion when the tip portion is threaded into the liquid container coupling portion 60 in direction of the arrow $P_1$. Alternative sealing means can be provided in connection with the liquid container 68.

As can be seen in FIG. 2, the liquid filling channel 40 is configured to communicate with a liquid outlet opening 70 of the liquid container 68 when the liquid container 68 is coupled to the atomizer/liquid reservoir portion.

In communication with the liquid refill channel 40 a check valve is provided in the form of an umbrella valve 144. The umbrella valve 144 allows liquid dispensed form the liquid container 68 to pass and to flow through the liquid refill channel 40 towards the liquid reservoir, as indicated by the arrows indicated L in FIG. 2.

Once liquid is filled into the liquid reservoir 34 through the liquid refill channel 40, air present in the liquid reservoir 34 preferably leaves the liquid reservoir 34, in order to avoid overpressure in the liquid reservoir. Air can leave the liquid reservoir 34 through the air outlet channel 42 (through the vent 46), as indicated by the arrow A in FIG. 2, and enter the atmosphere.

As shown in FIGS. 1 and 2, it may become necessary to slightly redirect the vapor channel 48 from a central position (defined by the central passage 32) in order to have enough room for the liquid container coupling portion 60.

Figure 3:
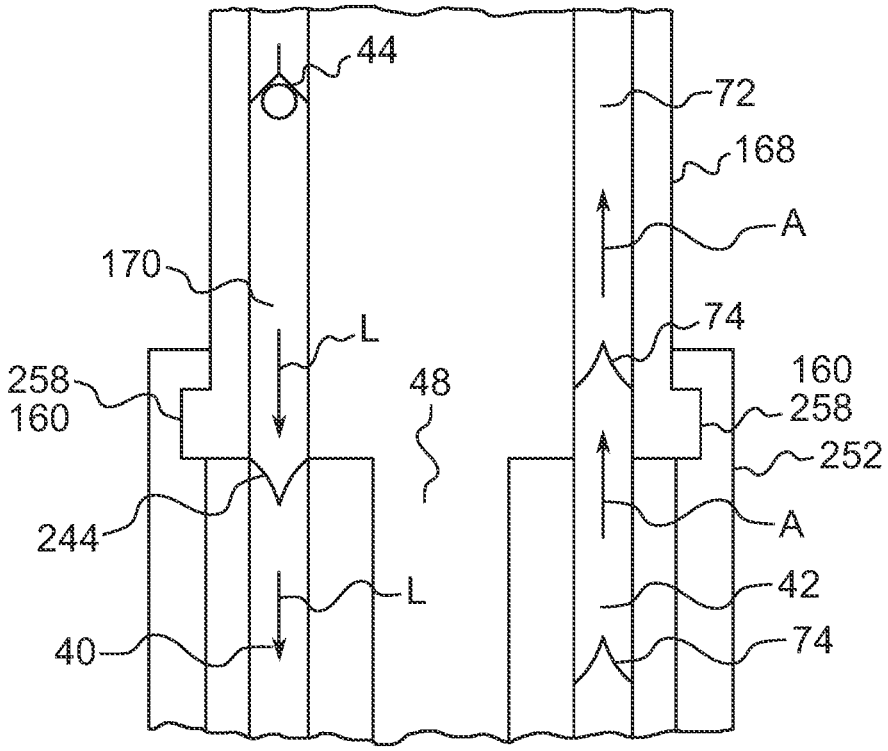
FIG. 3 is a schematic cross-sectional view illustrating coupling a liquid container to a liquid container coupling portion of an electronic cigarette according to a second embodiment.

FIG. 3 is a schematic cross-sectional view illustrating coupling a liquid container 168 to a liquid container coupling portion 160 of an electronic cigarette according to a second embodiment. The embodiment according to FIG. 3 differs from the embodiment in FIG. 2 in a number of aspects.

Figure 4:
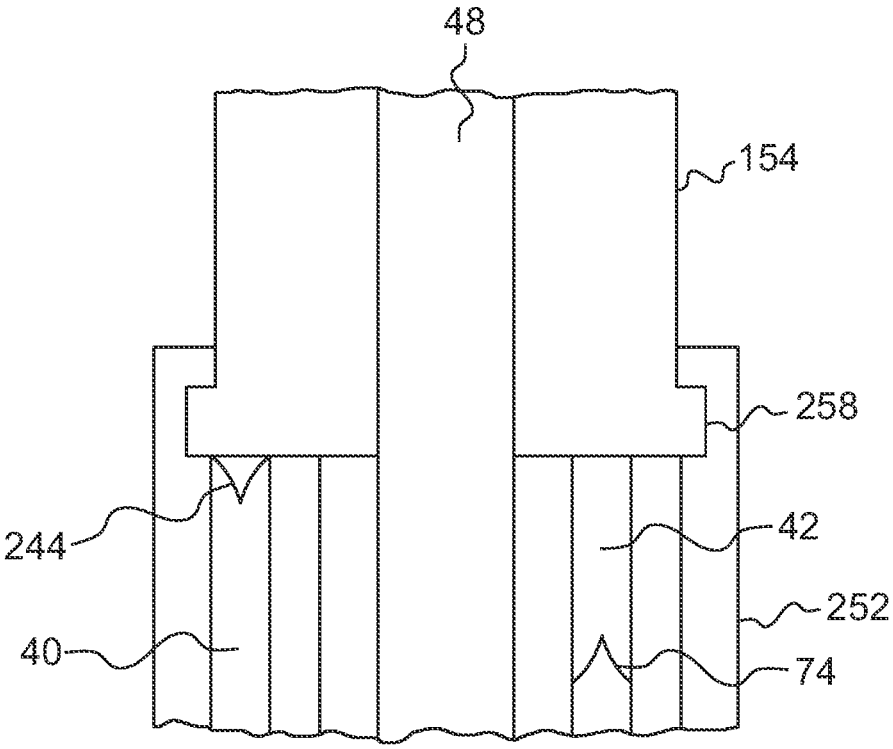
FIG. 4 is a schematic cross-sectional view illustrating coupling a mouthpiece to the electronic cigarette partially shown in FIG. 3.

The liquid container 168 is coupled to the atomizer/liquid reservoir portion, i.e. to the refill adapter portion 252 thereof, by means of a bayonet fitting. According to this embodiment, the liquid container coupling portion 160 is configured to also serve as a mouthpiece coupling portion 258, as can be seen in FIG. 4. Once the liquid container 168 is removed from the refill adapter portion 252, the mouthpiece 154 can be recoupled to the electronic cigarette in order to be operable in normal mode. This considerably simplifies the structure of the atomizer/liquid reservoir portion.

Further, the mouthpiece coupling portion 160, the mouthpiece 154 and the refill adapter portion 252 may be configured so that the liquid filling channel 40 and the air outlet channel 42 are sealed when the mouthpiece 154 is coupled to the refill adapter portion 252. In this case sealing elements for preventing liquid leaking from the liquid reservoir through the liquid refill channel or the air outlet channel, such as the check valves 144, 244 or the vent 46, are dispensable; thereby further simplifying the structure of the electronic cigarette. Respective sealing functionalities can be provided by coupling the mouthpiece to the remaining part of the atomizer/liquid reservoir portion, i.e. to the refill adapter portion or the base portion (cf. e.g. FIG. 7C) also with respect to other embodiments.

Further, according to the embodiment of FIG. 3, not only the liquid filling channel 40 is configured to communicate with a liquid outlet opening 170 of the liquid container 168 when the liquid container 168 is coupled to the atomizer/liquid reservoir portion, but also the air outlet channel 42 is configured to communicate with an air inlet opening 72 of the liquid container 168 when the liquid container 168 is coupled to the atomizer/liquid reservoir portion. This allows air leaving the liquid reservoir 34 through the air outlet channel 42 directly entering the liquid container 168 in order to equalize the pressure both in the liquid reservoir and the liquid container 168.

As check valve in communication with the liquid refill channel 40 a duck bill valve 244 is provided in the atomizer/liquid reservoir portion. Optional duck bill valves 74 are also provided in the air outlet channel 42 of the atomizer/liquid reservoir portion and in the air inlet opening 72 of the liquid container 168. The liquid outlet opening 170 of the liquid container is sealed by means of a check valve 44.

Needless to say the certain features of the embodiment according to FIG. 3 can be combined with or interchanged with features of the embodiment of FIG. 2 (and the embodiments to be described below), e.g. the type of the couplings, the type of the valves, etc. Further, a tip portion of a liquid container can be coupled to an atomizer/liquid reservoir portion as shown in FIG. 3, wherein the respective liquid container coupling 160 does not simultaneously serve as a mouthpiece coupling, but in order to couple a mouthpiece to the respective refill adapter portion, a separate mouthpiece coupling is provided (similar to the embodiment of FIG. 2).

Figure 5:
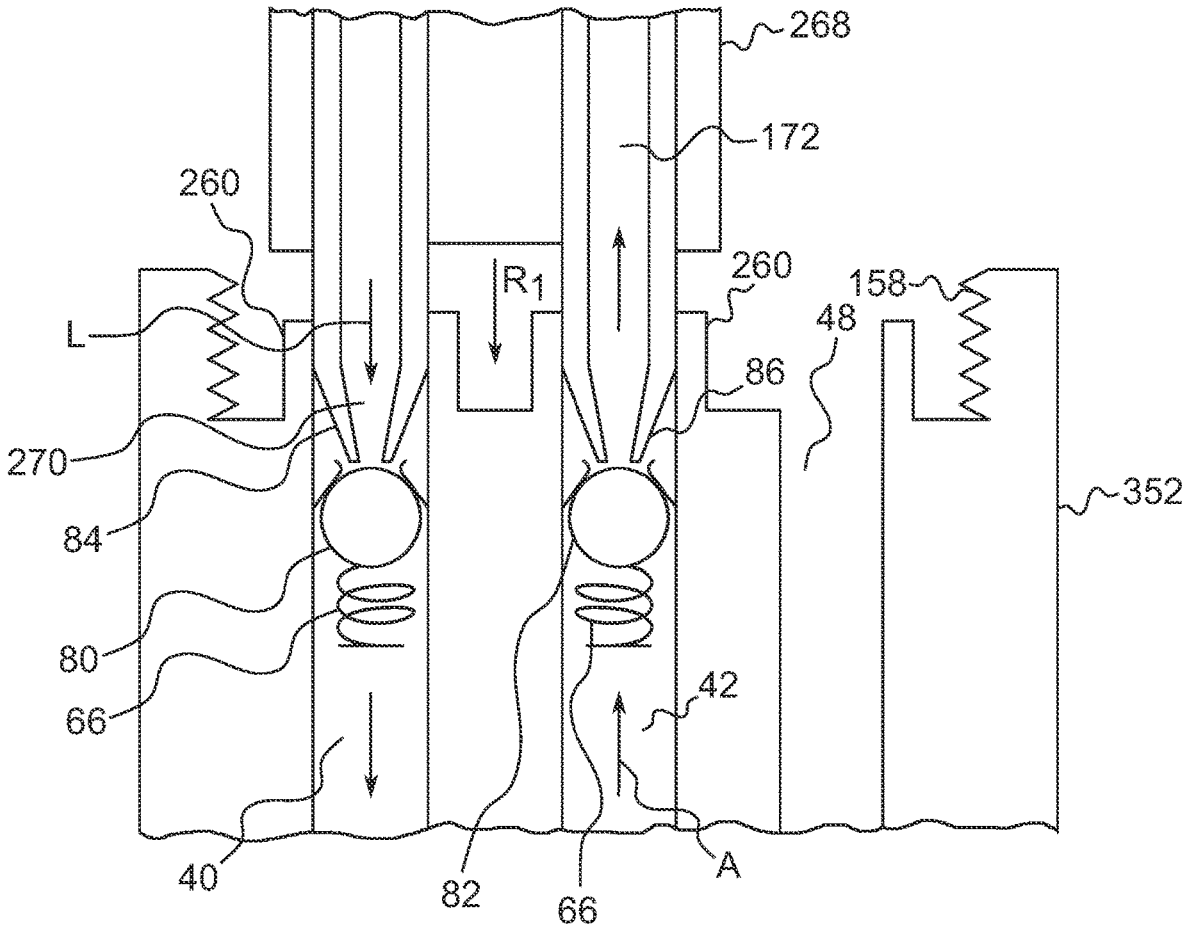
FIG. 5 is a schematic cross-sectional view illustrating coupling a liquid container to a liquid container coupling portion of an electronic cigarette according to a third embodiment.

FIG. 5 is a schematic cross-sectional view illustrating coupling a liquid container 268 to a liquid container coupling portion 260 of an electronic cigarette according to a third embodiment.

The liquid container 268 includes two contacting portions 84, 86 in the form of protruding channel portions. The channel portion on the left includes a liquid outlet opening 270 for providing liquid to the liquid filling channel 40 when the liquid container 268 is coupled with the liquid container coupling portion 260 of the refill adapter portion 352. The channel portion on the right includes an air inlet opening 172. The liquid container coupling portion 260 includes two sockets configured to receive the protruding channel portions so as to communicate with the liquid filling channel 40 and the air outlet channel 42, respectively.

In the liquid filling channel 40, a first valve element 80 is provided, which is configured, in a closed state, to prevent liquid from leaking from the liquid reservoir 34 through the liquid filling channel 40. The first valve element 80 is further configured, in an open state, to let pass liquid from the outside of the electronic smoking device through the liquid filling channel 40 to the liquid reservoir 34. The first valve element 80 is configured to be in a closed state when no liquid container is coupled to the atomizer/liquid reservoir portion and to be shifted to an open state by coupling a liquid container 268 to the atomizer/liquid reservoir portion. In the embodiment of FIG. 5, the first valve element 80 is provided in the form of a ball valve including a spring 66.

Analogously, the refill adapter portion 352 includes in the air outlet channel 42 a second valve element 82 that is configured, in a closed state, to prevent liquid from leaking from the liquid reservoir 34 through the air outlet channel 42, and, in an open state, to let pass air from the liquid reservoir 34 through the air outlet channel 42. The second valve element 82 is configured to be in a closed state when no liquid container is coupled to the atomizer/liquid reservoir portion and to be shifted to an open state by coupling a liquid container 268 to the atomizer/liquid reservoir portion. In the embodiment of FIG. 5, also the second valve element 80 is provided in the form of a ball valve including a spring 66.

According to a variant of this embodiment, a liquid container without the protruding channel portion including the air inlet opening 172 can be provided. In this case, the second valve element 82 is dispensable and the air outlet channel 42 can be configured to let pass air to the atmosphere, as described with respect to FIG. 2.

As exemplarily shown in FIG. 5, the first valve element 80 and the second valve element 82 are configured to be shifted from a closed state to an open state by being displaced against a preload (spring) 66 by means of a contacting portion 84, 86 of the liquid container 268 when the liquid container 268 is coupled to the atomizer/liquid reservoir portion. By inserting the protruding channel portions in direction of the arrow $R_1$ in FIG. 5 into the liquid filling channel and the air outlet channel 42, respectively, the ball valves 80, 82 are shifted to an open state, thereby allowing liquid provided from the liquid container 268 through the liquid outlet opening 270 to pass the valve 80 towards the liquid reservoir 34 and air from the air outlet channel 42 to pass the valve 82 towards the liquid container 268 through the air inlet opening 172.

Figure 6A:
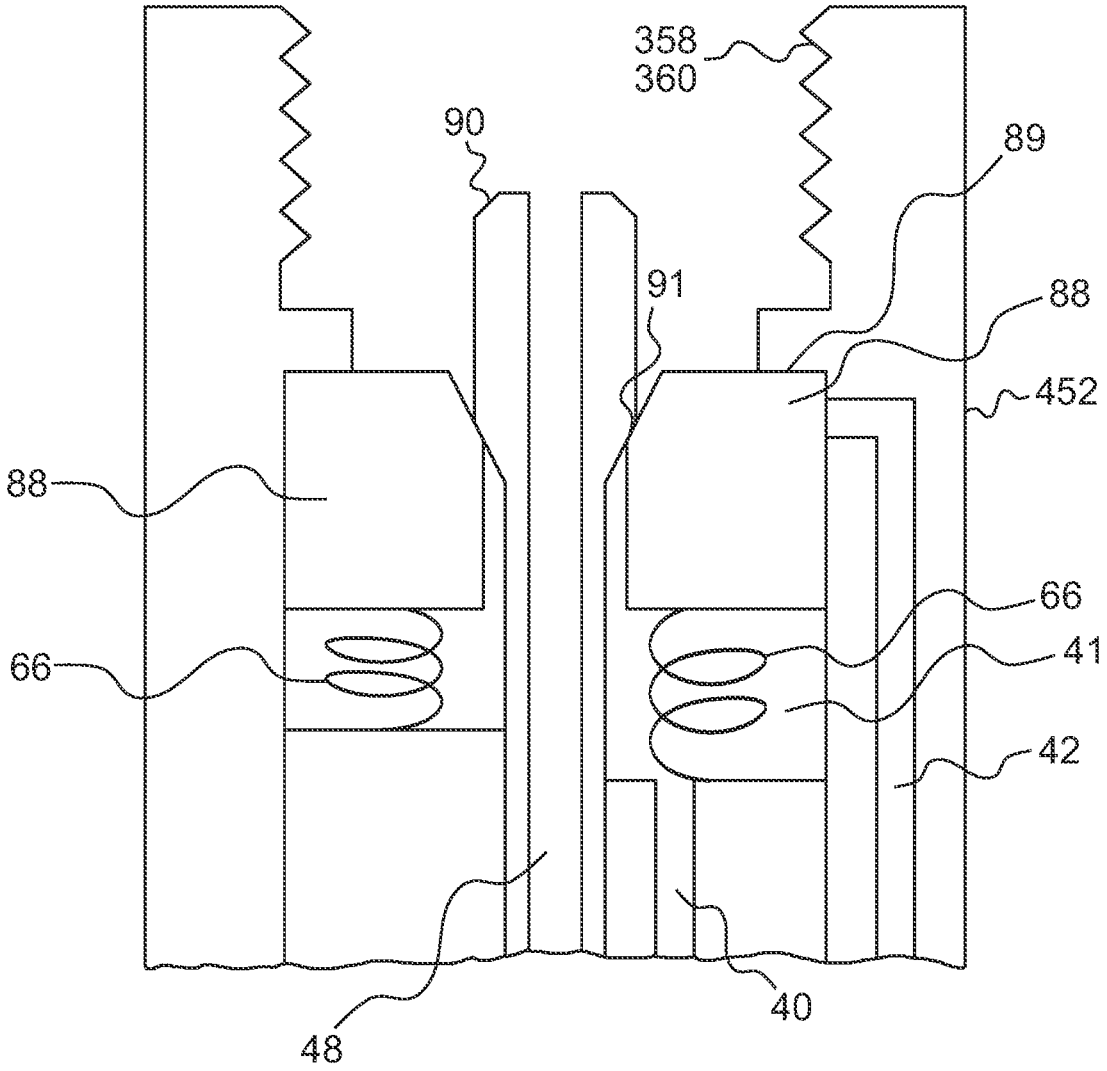
FIG. 6A is a schematic cross-sectional view illustrating a liquid container coupling portion of an electronic cigarette according to a fourth embodiment.

FIG. 6A is a schematic cross-sectional view illustrating a liquid container coupling portion 360 of an electronic cigarette according to a fourth embodiment.

While the liquid container coupling portion 360 according to FIG. 6A structurally considerably differs from the liquid container coupling portion 260 according to FIG. 5, functionally, there is an analogy. According to FIG. 6A, a common valve element 88 is provided, in the form of a plunger 88 in connection with a spring 66, which plunger 88 functions both as a first valve element 80 and a second valve element 82 as described with reference to FIG. 5.

In other words, the common valve element 80 is configured, in a closed state, to prevent liquid from leaking from the liquid reservoir 34 through the liquid filling channel 40 and the air outlet channel 42. To that end, the plunger 88 seals both the upper opening of the air outlet channel 42 as well as the chamber 41, an extension of the liquid filling channel, namely by being pushed upwards by means of the spring 66 towards the edge 89 of the inner sidewall of the refill adapter portion 452 and the edge 91 of the central pin 90, which includes the vapor channel 48. As can be seen from FIG. 6A, the common valve element 88 is configured to be in a closed state when no liquid container 368 is coupled to the atomizer/liquid reservoir portion.

Figure 6B:
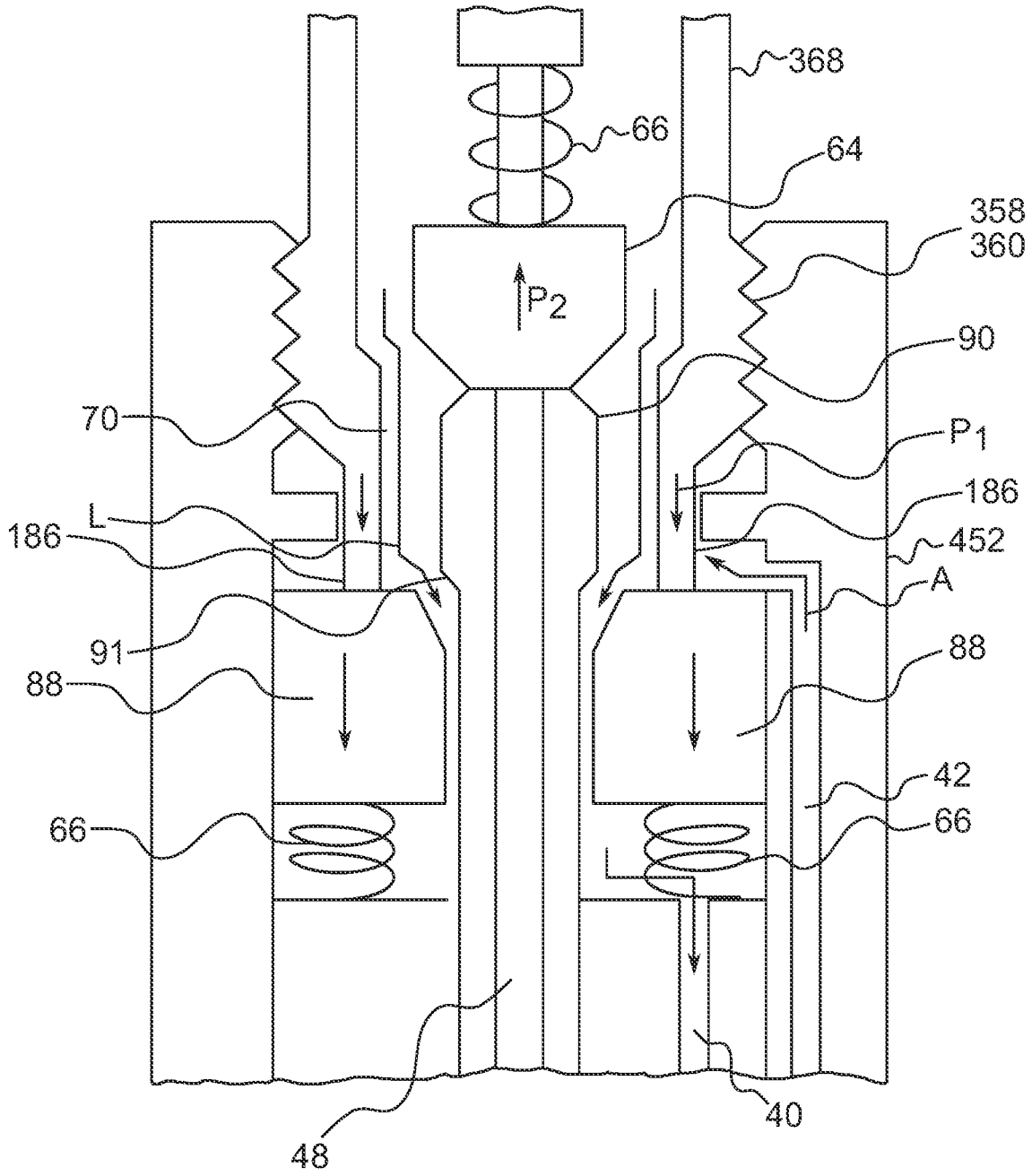
FIG. 6B is a schematic cross-sectional view illustrating coupling a liquid container to the liquid container coupling portion of FIG. 6A.

On the other hand, as illustrated in FIG. 6B, the common valve 88 is configured to be shifted to an open state by coupling a liquid container 368 to the atomizer/liquid reservoir portion, and, in the open state, to let pass liquid from the outside of the electronic smoking device through the liquid filling channel 40 to the liquid reservoir 34 and to let pass air form the liquid reservoir 34 through the air outlet channel 42. This is because the common valve 88 is configured to be shifted from a closed state to an open state by being displaced against a preload (spring) 66 by means of a contacting element 186 of the liquid container 368 when the liquid container 368 is coupled to the atomizer/liquid reservoir portion, as described below in detail.

The liquid container 368, a tip portion of which is shown in FIG. 6B, essentially corresponds to the liquid container 68 shown in FIG. 2 as regards the function of the valve element 64. By screwing the tip portion into the liquid container coupling portion 360 in direction $P_1$, the valve elements 64 abuts against the pin 90 and is pushed in direction $P_2$, thereby providing a liquid outlet opening 70 for the liquid along the pin 90.

At the same time, by moving the tip portion of the liquid container in direction $P_1$, the contacting elements 186 abut against the plunger 88 and push down the plunger 88, as indicated by the respective arrows in FIG. 6B. This dislocation of the plunger 88 results in that the air outlet channel 42 is opened. Air can leave the liquid reservoir 34 through the air outlet channel 42. On the other hand, also the chamber 41 is opened because the plunger 88 no longer contacts the edge 91 of the pin 90. As a result liquid from the liquid container 368 can enter the chamber 41 and the liquid filling channel 40 at the bottom of the chamber 41.

Figure 7A:
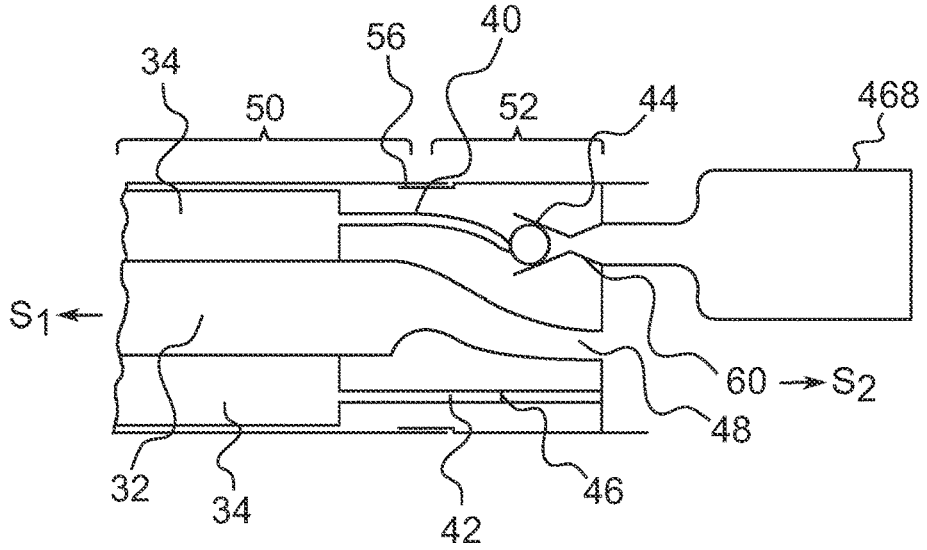
FIG. 7A is a schematic cross-sectional partial view of an atomizer/liquid reservoir portion of an electronic cigarette, the atomizer/liquid reservoir portion comprising a base portion including the liquid reservoir and a refill adapter portion, which in FIG. 7A is coupled with a liquid container.

FIG. 7A is a schematic cross-sectional partial view of an atomizer/liquid reservoir portion of an electronic cigarette, the atomizer/liquid reservoir portion comprising a base portion 50 including the liquid reservoir (and the atomizer, not shown in FIG. 7A) and a refill adapter portion 52, which in FIG. 7A is coupled with a liquid container 468 via a liquid container coupling portion 60.

As already mentioned with respect to FIG. 1, the atomizer/liquid reservoir portion can have a multi-piece structure including the base portion 50 and a refill adapter portion 52 removably coupleable with the base portion 50. In this case at least a part of the liquid filling channel 40 and at least a part of the air outlet channel 42 extend through the refill adapter portion 52 and the refill adapter portion 52 includes the liquid container coupling portion 60. According to an alternative embodiment, the base portion 50 and the refill adapter portion 52 can be integrally formed, i.e. in this case, the atomizer/liquid reservoir portion includes two pieces, an integrally formed base and refill adapter portion and a removable mouthpiece.

As shown in FIG. 7A, the atomizer/liquid reservoir portion has a cylindrical shape extending along a longitudinal direction of the electronic smoking device, wherein a first end side $S_1$ of the cylinder faces the power supply portion (not shown; cf. FIG. 1). The liquid container coupling portion 60 faces a second side $S_2$ opposite to the first side $S_1$. The liquid filling channel 40 and the air outlet channel 42 include an opening facing the second side $S_2$, respectively. This general architecture, which is also referred to as top-fill-arrangement, can be applied to all embodiments described in this document.

Figure 7B:
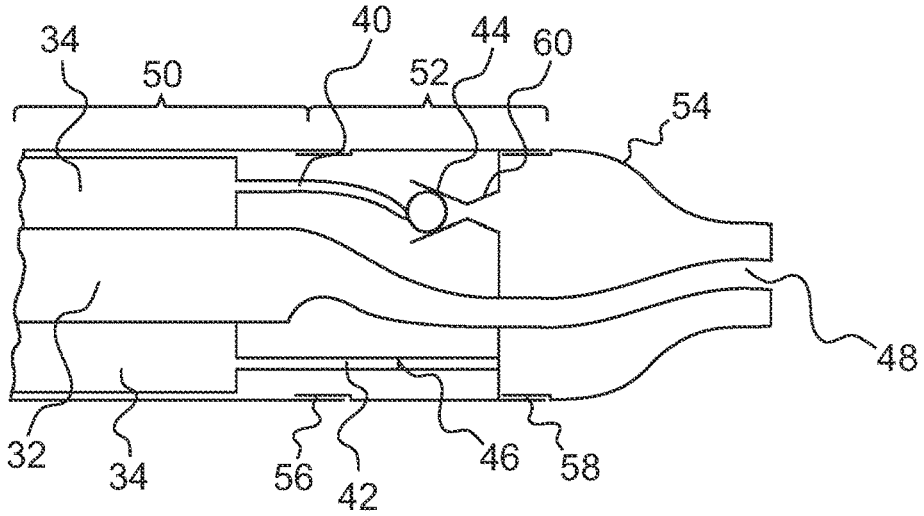
FIG. 7B is a schematic cross-sectional partial view of the atomizer/liquid reservoir portion of FIG. 7A, wherein a mouthpiece is coupled to the refill adapter portion.

FIG. 7B is a schematic cross-sectional partial view of the atomizer/liquid reservoir portion of FIG. 7A, wherein a mouthpiece 54 is coupled to the refill adapter portion 52. To that end, as already described above in more detail, the refill adapter portion 52 includes a mouthpiece coupling portion 58 and the mouthpiece 54 is configured to be coupled to a mouthpiece coupling portion 58 of the refill adapter portion 52. While in the example in FIG. 7B, the mouthpiece coupling portion 58 is separate from the liquid container coupling portion 60, generally, as e.g. described with reference to FIGS. 3, 4, the mouthpiece coupling portion 258 can be configured to also serve as liquid container coupling portion 160.

Figure 7C:
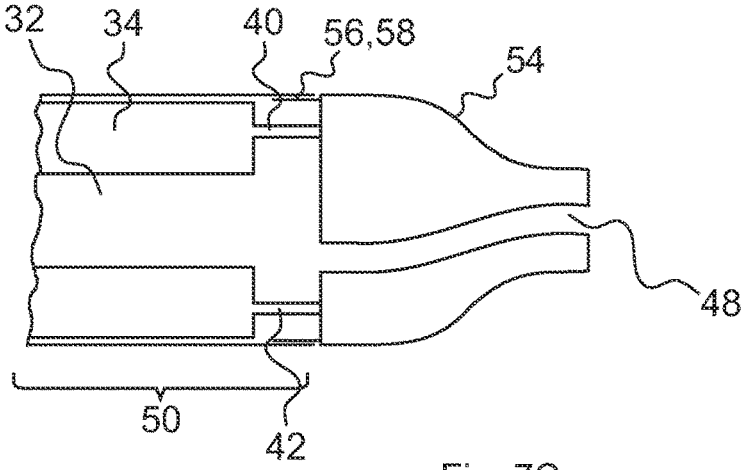

According to an alternative embodiment, illustrated in FIG. 7C, the base portion 50 includes a mouthpiece coupling portion 58 and the mouthpiece 54 is configured to be coupled to the mouthpiece coupling portion 58 of the base portion 50 in a state in which the refill adapter portion 52 is removed from the base portion 50. In this case, the mouthpiece coupling portion 58 is configured to also serve as refill adapter coupling portion 56 for coupling the refill adapter 52 to the base portion 50.

As mentioned before, the liquid filling channel 40 and the air outlet channel 42 include an opening facing the second side $S_2$, respectively. However, besides this top-fill-arrangement-architecture or design, also electronic smoking devices with a so called side-fill-arrangement architecture/design can be realized. In such side-fill concepts, the liquid filling channel and the air outlet channel include openings which are arranged within a side portion of the atomizer/liquid reservoir portion of the electronic smoking device. In such embodiments, the opening of the liquid filling channel and of the air outlet channel is arranged in a side wall of the electronic smoking device and at least a part of the liquid filling channel and of the air outlet channel extends in a direction which is perpendicular to the longitudinal direction of the atomizer/liquid reservoir portion of the electronic smoking device respectively. Thus, the opening of the liquid filling channel and of the air outlet channel is arranged within a side wall of the housing of the electronic smoking device respectively.

Figure 8:
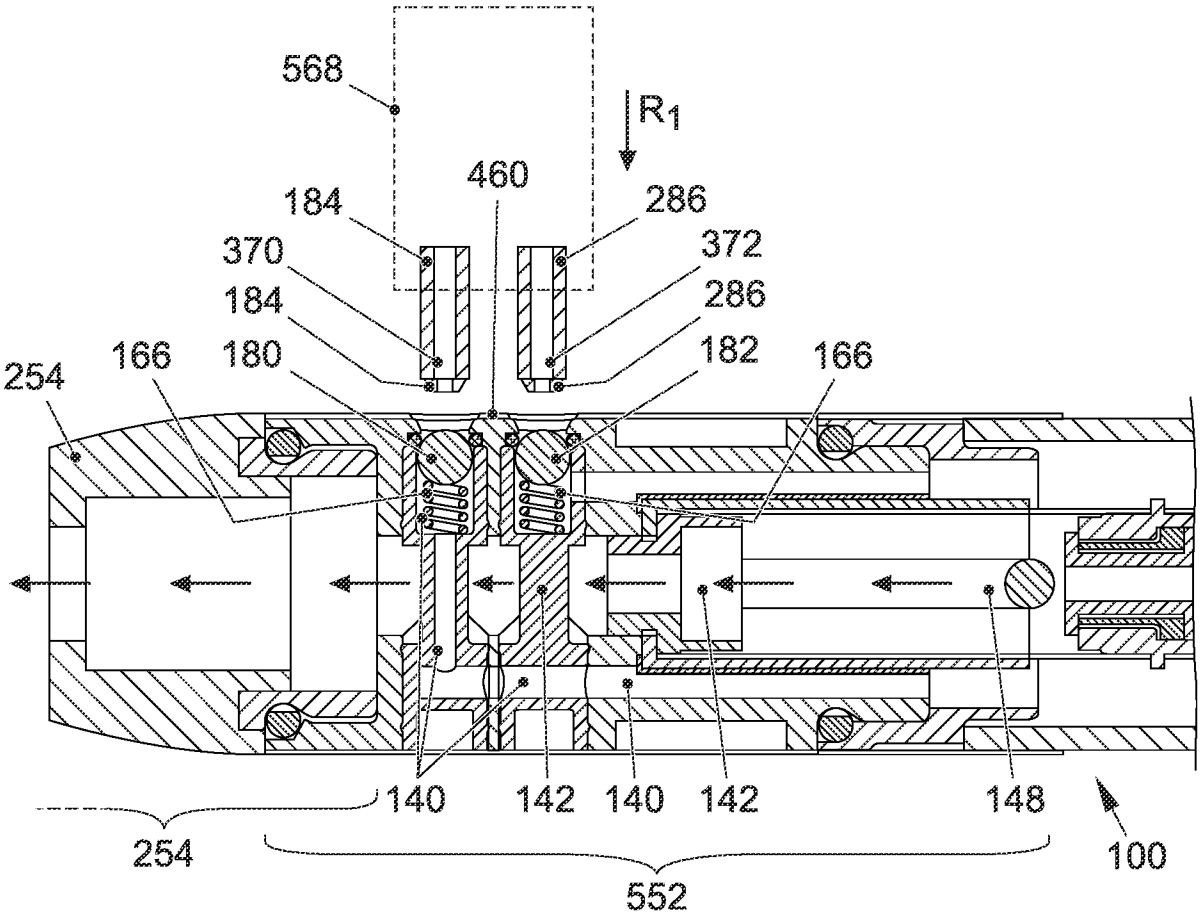
FIG. 8 is a schematic cross-sectional illustration of an alternative embodiment of an electronic smoking device.

A schematical cross-section of an alternative embodiment is shown in FIG. 8. FIG. 8 shows an electronic smoking device 100 which can be filled from the side in a horizontal orientation. Thus, the direction in which the electronic smoking device 100 can be connected to a liquid container is perpendicular to the flow direction of aerosol or vaporized liquid when drawn out of the mouthpiece 254, wherein the aforementioned flow direction in FIG. 8 is indicated via arrows. Therefore, the direction in which the electronic smoking device 100 can be connected to a liquid container and be refilled is perpendicular to the vapor channel 148. The alternative embodiment as shown in FIG. 8 is substantially identical to the embodiment of an electronic smoking device 100 as shown in FIG. 5. In more detail, also FIG. 8 is a schematic cross-sectional view illustrating the coupling of a liquid container 568 to a liquid container coupling portion 460 of an electronic smoking device 100 according to this alternative embodiment. The liquid container coupling portion 460 is arranged on and within a side wall of the atomizer/liquid reservoir portion and thus on a side wall of the refill adapter portion 552 of the electronic smoking device 100.

The liquid container 568 will be described in greater detail with respect to FIG. 9. In FIG. 8, only the contacting portions 184, 286 of the liquid container 568 are illustrated, while the actual liquid container 568 is only schematically indicated via a dotted line. Also in this alternative embodiment, the liquid container 568 includes two contacting portions 184, 286 in the form of protruding channel portions. The channel portion on the left includes a liquid outlet opening 370 for providing liquid to the liquid filling channel 140 when the liquid container 568 is coupled with the liquid container coupling portion 460. The channel portion on the right includes an air inlet opening 372. The liquid container coupling portion 460 includes two sockets configured to receive the protruding channel portions so as to communicate with the liquid filling channel 140 and the air outlet channel 142, respectively.

In the liquid filling channel 140, a first valve element 180 is provided, which is configured, in a closed state, to prevent liquid from leaking from the liquid reservoir of the electronic smoking device 100 through the liquid filling channel 140. The first valve element 180 is further configured, in an open state, to let pass liquid from the outside of the electronic smoking device 100 through the liquid filling channel 140 to the liquid reservoir of the electronic smoking device 100. The first valve element 180 is configured to be in a closed state when no liquid container 568 is coupled to the atomizer/liquid reservoir portion and to be shifted to an open state by coupling a liquid container 568 to the atomizer/liquid reservoir portion. Also in the alternative embodiment shown in FIG. 8, the first valve element 180 is provided in the form of a ball valve including a spring 166.

Furthermore, the electronic smoking device 100 includes a second valve element 182 in the air outlet channel 142, the second valve element 182 being configured, in a closed state, to prevent liquid from leaking from the liquid reservoir of the electronic smoking device 100 through the air outlet channel 142, and, in an open state, to let pass air from the liquid reservoir through the air outlet channel 142. The second valve element 182 is configured to be in a closed state when no liquid container 568 is coupled to the atomizer/liquid reservoir portion and to be shifted to an open state by coupling a liquid container 568 to the atomizer/liquid reservoir portion. In the embodiment shown in FIG. 8, also the second valve element 182 is provided in the form of a ball valve including a spring 166.

According to a variant of this embodiment, a liquid container without the protruding channel portion including the air inlet opening 372 can be provided. In this case, the second valve element 182 is dispensable and the air outlet channel 142 can be configured to let pass air to the atmosphere, as described with respect to FIGS. 2 and 5.

As exemplarily shown in FIG. 8, the first valve element 180 and the second valve element 182 are configured to be shifted from a closed state to an open state by being displaced against a preload (spring) 166 by means of a contacting portion 184, 286 of the liquid container 568 when the liquid container 568 is coupled to the atomizer/liquid reservoir portion. By inserting the protruding channel portions in direction of the arrow $R_1$ in FIG. 8 into the liquid filling channel 140 and the air outlet channel 142, respectively, the ball valves 180, 182 are shifted to an open state, thereby allowing for liquid provided from the liquid container 568 through the liquid outlet opening 370 to pass the valve 180 towards the liquid reservoir of the electronic smoking device 100 and air from the air outlet channel 142 to pass the valve 182 towards the liquid container 568 through the air inlet opening 372.

Figure 9:
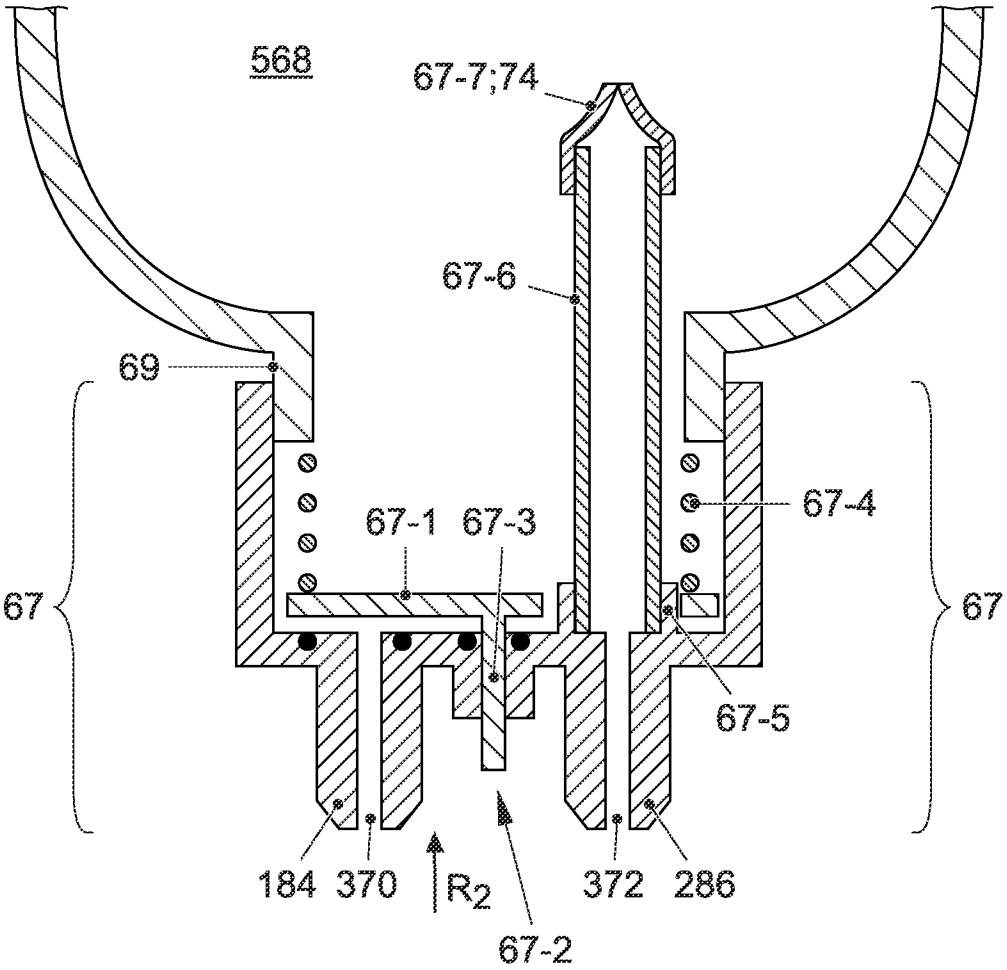
FIG. 9 is a schematic cross-sectional illustration of a coupling portion of a liquid container usable to (re)fill the liquid reservoir of the alternative embodiment of an electronic smoking device of FIG. 8.

However, as shown in FIG. 9, also the liquid container 568 comprises blocking elements which block an undesired flow of liquid and of air in particular states of the liquid container 568 and in particular directions respectively. In more detail, a cross-sectional illustration of a coupling portion 67 of the liquid container 568 is shown in FIG. 9. The liquid container 568 is realized as refill bottle which resembles a bottle for medicine or a dropper bottle that is used for dispensing eye drops. The liquid container 568 comprises a circular bottle neck 69 enclosing an opening of the refill bottle arranged therein. In this embodiment of the liquid container 568, the refill bottle is configured squeezable, enabling to for example pinch the sidewalls of the refill bottle, thus allowing for liquid to be ousted out of the opening enclosed by the bottle neck 69.

The coupling portion 67 of the liquid container 568 comprises a substantially circular body which has a rectangular cross-section and which is fixed onto the bottle neck 69 of the liquid container 568. In this embodiment, the coupling portion 67 is glued onto the bottle neck 69. However, the coupling portion 67 can also comprise other connection means, for example an internal screw thread which can be screwed onto an external screw thread that is arranged on the outer periphery of the bottle neck 69.

The contacting portions 184, 286 of the liquid container 568 protrude from the coupling portion 67. Furthermore, a spring loaded first blocking element 67-1 is arranged within the coupling portion 67 of the liquid container 568. The first blocking element 67-1 has the shape of a plate with a pin 67-2 arranged thereon. The plate of the blocking element 67-1 covers the liquid outlet opening 370 of the left contacting portion 184 of the liquid container 568 in a state in which the liquid container 568 is not connected to the electronic smoking device 100. In this unconnected state, liquid from within the liquid container 568 cannot flow out of the same via the left contacting portion 184. Thus, the flow of liquid out of the liquid container 568 is blocked in the unconnected state of the same. The pin 67-2 is arranged substantially perpendicular to the plate of the blocking element 67-1 and protrudes out of an opening 67-3 which is arranged in between the contacting portions 184, 286 within the coupling portion 67 of the liquid container 568. A spring 67-4 is arranged within the coupling portion 67, in between the rim of the bottle neck 69 of the liquid container 568 and the first blocking element 67-1. Thus, when the liquid container 568 is connected to the electronic smoking device 100, the pin 67-2 will be in contact with the electronic smoking device 100 and pushed into a direction $R_2$ which is opposite to the insertion direction $R_1$ (see FIG. 8) and indicated via an arrow in FIG. 9. This will lift the first blocking element 67-1 into an upwards direction, away from the inner bottom portion of the coupling portion 67 of the liquid container 568, giving free the liquid outlet opening 370 of the left contacting portion 184, thereby allowing for liquid to flow out of the liquid container 568.

When the first blocking element 67-1 is lifted, the spring 67-4 is compressed. Thus, liquid can only be expelled via the left contacting portion 184 when the liquid container 568 is connected to the liquid container coupling portion 460 of the electronic smoking device 100. When the liquid container 568 is retracted from the liquid container coupling portion 460 of the electronic smoking device 100, the spring 67-4 within the coupling portion 67 will relax, expand and push the first blocking element 67-1 back onto the bottom portion of the coupling portion 67 of the liquid container 568, thereby covering up the liquid outlet opening 370 of the left contacting portion 184 again.

Furthermore, the right contacting portion 286 comprises an internal collar 67-5 protruding from the internal opening—communicating with the air inlet opening 372—of the right contacting portion 286 in a direction pointing towards the inner volume of the liquid container 568. A hollow tube element 67-6 is arranged within the internal collar 67-5, the hollow tube element 67-6 comprising a first end and a second end. The first end of the hollow tube-element 67-6 is received by the internal collar 67-5 and enclosed by the same. The connection between the first end of the hollow tube-element 67-6 and the internal collar 67-5 is tight enough to seal the connection, preventing air from entering or exiting the connection between the first end of the hollow tube-element 67-6 and the internal collar 67-5.

The second end of the hollow tube-element 67-6 is connected to a second blocking element 67-7, which in this embodiment is realized as a check valve. The check valve is exemplarily realized as a duck bill valve 74. The duck bill valve 74 allows for air to be ousted out of the hollow tube element 67-6, but prevents air or liquid given within the liquid container 568 to enter the hollow tube element 67-6. Thus, when the liquid container 568 is connected to the electronic smoking device 100 as shown in FIG. 8, air which is ousted from the liquid reservoir of the electronic smoking device 100 will be transported into the hollow tube element 67-6 via the right contacting portion 286. From the hollow tube element 67-6, the air will flow into an upper portion of the liquid container 568 via the duck bill valve 74.

As can be seen in FIGS. 8 and 9, in this alternative embodiment of the electronic smoking device 100, the electronic smoking device 100 can be (re)filled with liquid without that the mouthpiece 254 of the electronic smoking device 100 needs to be removed. This allows for a less complex and faster refill procedure.

Figure 10A:
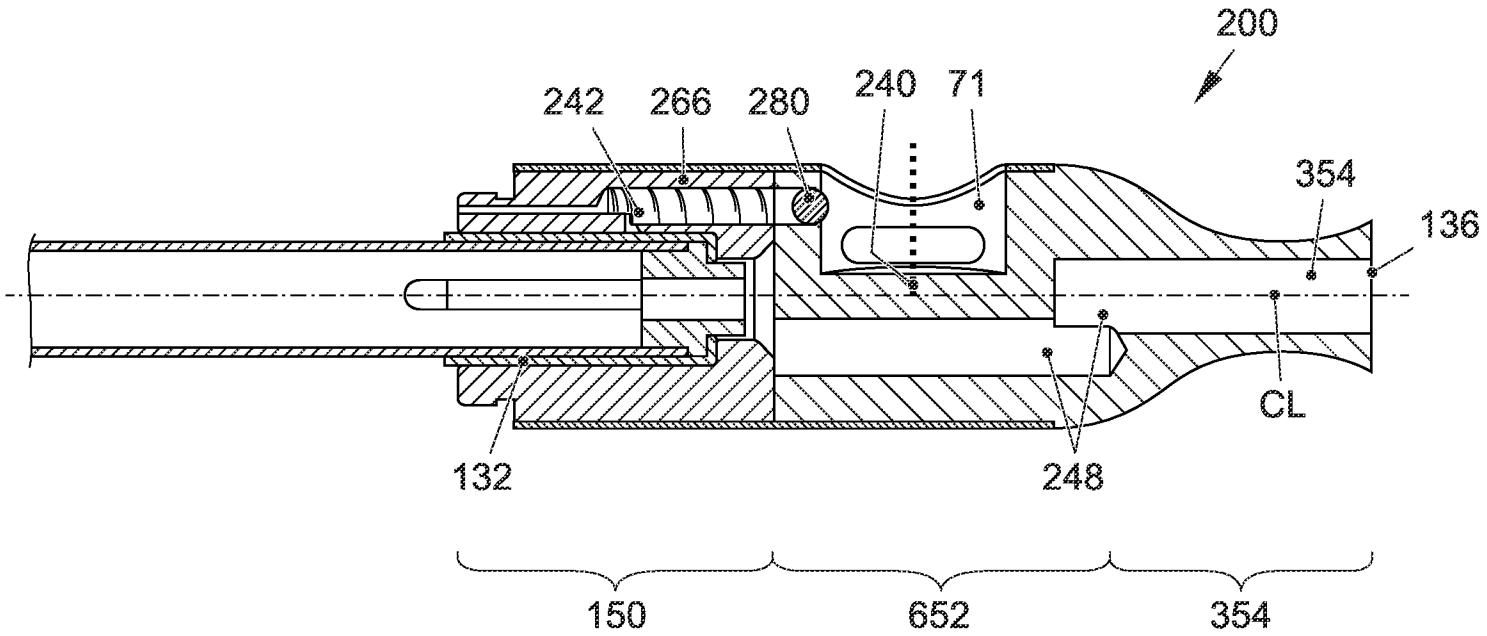
FIG. 10*a* is a schematic cross-sectional illustration of a further alternative embodiment of an electronic smoking device shown from a first perspective.
Figure 10B:
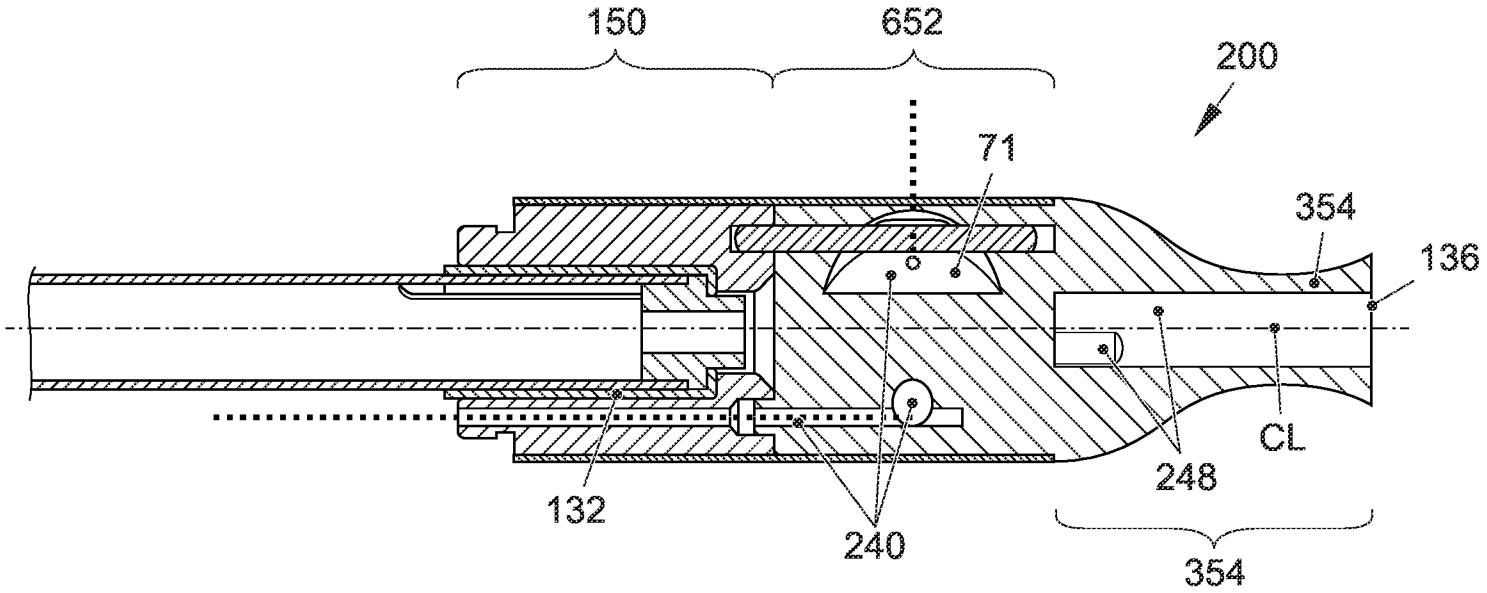
FIG. 10*b* is a schematic cross-sectional illustration of the further alternative embodiment of an electronic smoking device of FIG. 10*a* shown from a second perspective.
Figure 10C:
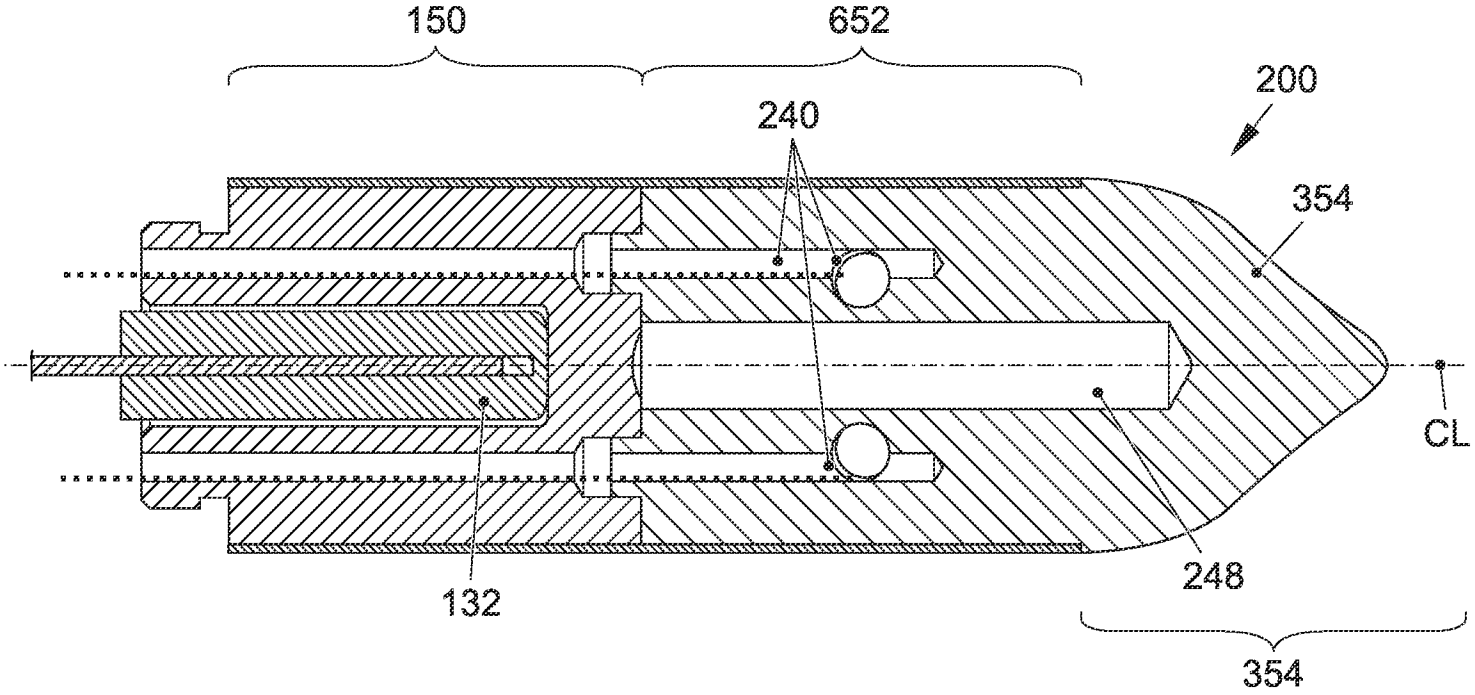
FIG. 10*c* is a schematic cross-sectional illustration of the further alternative embodiment of an electronic smoking device of FIGS. 10*a* and 10*b* shown from a third perspective.

In the FIGS. 10*a*, 10*b* and 10*c*, a further alternative embodiment of an electronic smoking device 200 is illustrated from different perspectives. This further alternative embodiment of an electronic smoking device 200 is substantially identical to the electronic smoking device 100 shown in FIG. 8 and also has a side-fill architecture, being fillable from a side when in a horizontal orientation. Thus, in this alternative embodiment, a liquid container (not shown) can be connected to a side portion of the atomizer/liquid reservoir portion of the electronic smoking device 200. Also in this alternative embodiment, the electronic smoking device 200 comprises a refill adapter portion 652 connected to a mouthpiece 354 and to a base portion 150. The refill adapter portion 652 and the base portion 150 substantially have a cylindrical shape, substantially resembling a tube. In this alternative embodiment, a refill hole 71 is arranged within the aforementioned side portion of the atomizer/liquid reservoir portion of the electronic smoking device 200. In more detail, the refill hole 71 is arranged within a side portion of the refill adapter portion 652 of the electronic smoking device 200. The refill hole 71 is adapted to receive the nib of a liquid container which in this embodiment is realized as a refill bottle. Expressed in other words, the refill hole 71 allows for a coupling portion attached to the bottle neck of a liquid container (not shown) to be fully inserted into the refill hole 71. In this alternative embodiment, the connection portion of the bottle neck or a nib of the refill bottle can be connected to the refill hole 71 via a bayonet connection. Thus, the refill hole 71 is provided with connection holes and connection edges allowing for a bayonet connection element (not shown) arranged on the nib/coupling portion of a liquid container to engage with the connection holes and connection edges of the refill hole 71. Thus, when the bayonet connection element of the nib of a liquid container is in an engaged state, the nib of the liquid container is in alignment with the refill hole 71.

In this alternative embodiment of an electronic smoking device 200, the electronic smoking device 200 comprises an air outlet channel 242 which is arranged in parallel to the length of the electronic smoking device 200. The air outlet channel 242 communicates with the liquid reservoir (not shown) of the electronic smoking device 200 and is configured to let pass air out of the liquid reservoir. The air outlet channel 242 extends from the base portion 150 into the refill adapter portion 652 of the electronic smoking device 200, wherein the air outlet channel 242 is arranged in parallel to the substantially tube-shaped side walls of the base portion 150 and of the refill adapter portion 652 and to the central passage 132 of the electronic smoking device 200 extending centrally within the base portion 150. Expressed in other words, the air outlet channel 242 is arranged perpendicular to the direction of insertion of the nib of a liquid container with respect to the refill opening 71. Furthermore, the air outlet channel 242 extends into the refill opening 71, allowing for air to be ousted to an outside of the electronic smoking device 200. A valve element 280 is provided within the air outlet channel 242, which is configured, in a closed state, to prevent liquid and air from leaking from the liquid reservoir of the electronic smoking device 200 through the air outlet channel 242. The valve element 280 is further configured, in an open state, to let pass air from the liquid reservoir of the electronic smoking device 200 through the air outlet channel 242 to an outside of the electronic smoking device 200, especially into a liquid container coupled to the refill opening 71. The valve element 280 is configured to be in a closed state when no liquid container is coupled to the refill opening 71 and to be shifted to an open state by coupling a liquid container to the refill opening 71. Also in this alternative embodiment shown in FIGS. 10*a* to 10*c*, the valve element 280 is provided in the form of a ball valve including a spring 266. Thus, when the nib of the liquid container is inserted into the refill opening 71, the nib will push the ball of the ball valve into the air outlet channel 242, thereby giving free the opening of the same, allowing for air to pass the valve element 280 and compressing the spring 266. When the liquid container with the nib is retracted from the refill opening 71, the compressed spring will be transferred into a relaxed state, pushing the ball of the ball valve back into the opening of the air outlet channel 242, thereby blocking the same, preventing air from escaping the air outlet channel 242.

Moreover, the electronic smoking device 200 comprises a vapor channel 248 which communicates with the central passage 132 of the base portion 150 and the air inhalation port 136 of the mouthpiece 354. Due to the positioning of the refill opening 71, the vapor channel 248 is redirected and comprises a first part and a second part, wherein the first part is flowing into the second part. The first part of the vapor channel 248 substantially extends within the refill adapter portion 652 and is dislocated with respect to a center line CL of the electronic smoking device 200 which in FIG. 10*a* is illustrated via a dashed line. The second part of the vapor channel 248 is arranged within the mouthpiece 354, is aligned to the center line CL of the electronic smoking device 200 and in communication with the first part of the vapor channel 248. The first part of the vapor channel 248 is in communication with the central passage 132 of the electronic smoking device 200.

In this alternative embodiment, the electronic smoking device 200 further comprises two liquid filling channels 240 which in FIG. 10*a* are only indicated via a dotted line but not visible. The liquid filling channels 240 are in part visible in FIGS. 10*b* and 10*c*. FIG. 10*b* illustrates another perspective of the embodiment of the electronic smoking device 200 shown in FIG. 10*a*. Expressed in other words, FIG. 10*b* shows the electronic smoking device 200 as shown in FIG. 10*a* from a different angle. The angled perspective allows for an insight into the refill opening 71. The refill opening 71 comprises a cavity section which has the shape of a circular cut-out and is adapted to receive the nib of the liquid container. The openings of the two liquid filling channels 240 are arranged within a bottom part of the cavity section of the refill opening 71. In FIG. 10*b*, only the first of the two liquid filling channels 240 is shown, indicated via a dotted line. Accordingly, only the first opening of the first liquid filling channel 240 is visible in the bottom part of the cavity section of the refill opening 71.

However, both liquid filling channels 240 are visible to the user in FIG. 10*c*, which illustrates another perspective of the embodiment of the electronic smoking device 200 as shown in FIGS. 10*a* and 10*b*. In more detail, in FIG. 10*c*, a cross-section through the electronic smoking device 200 and through both liquid filling channels 240 is illustrated. Also in FIG. 10*c*, the liquid filling channels 240 are illustrated via a dotted line. The liquid filling channels 240 communicate with the liquid reservoir (not shown) of the electronic smoking device 200 and comprise a first section which is parallel to the center line CL of the electronic smoking device 200 and a second section which is perpendicular to the center line CL of the electronic smoking device 200 respectively. The second sections of the liquid filling channels 240 have an opening arranged within the bottom part of the cavity section of the refill opening 71 respectively.

When the nib of a liquid container is inserted into the refill opening 71, the ball valve is actuated, opening the air outlet channel 242. Furthermore, two openings arranged within the nib are aligned with the openings of the second sections of the liquid filling channels 240 respectively. Liquid which flows out of the liquid container flows into the openings and through the first and the second sections of the liquid filling channels 240, into the liquid reservoir of the electronic smoking device 200. When the liquid flows into the liquid reservoir of the electronic smoking device 200, air is ousted out of the same and flows through the air outlet channel 242. Some liquid containers used to refill the electronic smoking device 200 shown in the FIGS. 10*a* to 10*c* comprise an air inlet portion adapted to recapture air that exits the air outlet channel 242 of the electronic smoking device 200. Thus, air ousted from a top side of the liquid reservoir of the electronic smoking device 200 flows back into the liquid container.

When the filling process or the refill process is completed, the liquid container is retracted from the electronic smoking device 200 and the refill opening 71 is closed via a cap fully covering the refill opening 71. Thus, any rest liquid contained within the refill opening 71 is capped off and cannot be spilled.

Figure 11:
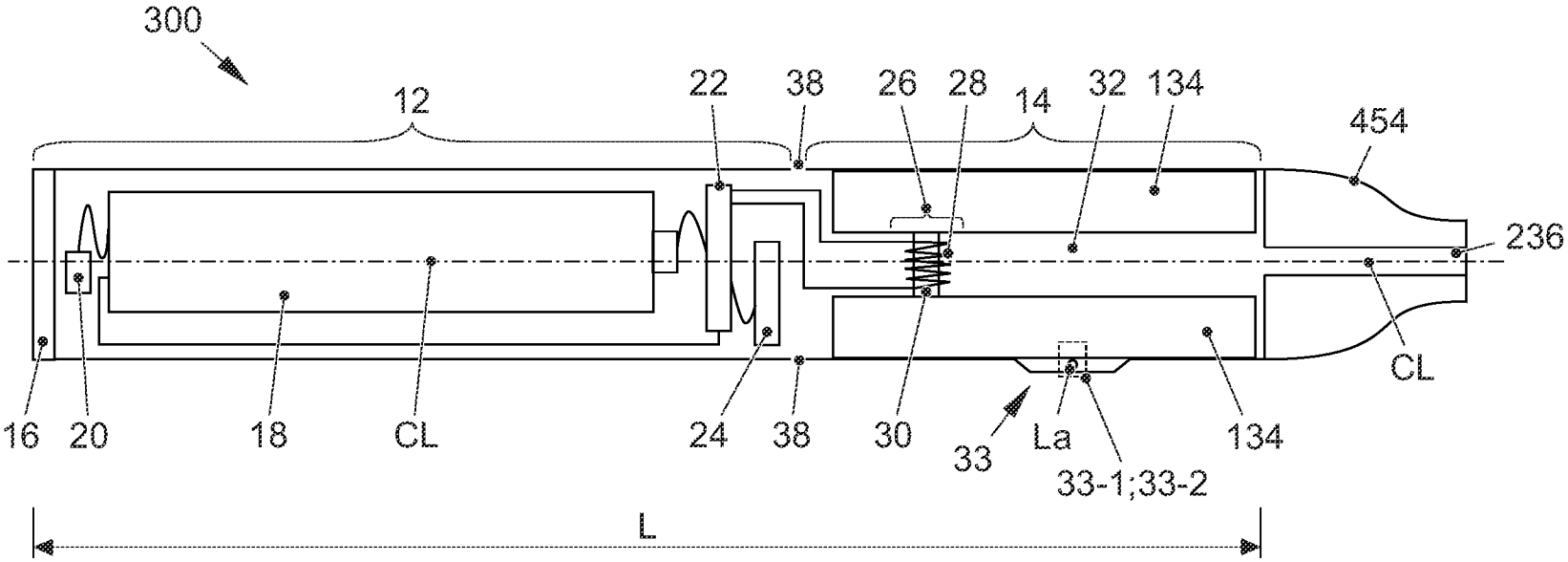
FIG. 11 is a schematic cross-sectional illustration of a further embodiment of an electronic smoking device.

In FIG. 11, it is shown a schematic cross-sectional illustration of a further embodiment of an electronic smoking device 300. The further embodiment shown in FIG. 11 is substantially identical to the embodiment of an electronic smoking device 10 shown in FIG. 1. However, in this embodiment, the liquid reservoir 134 of the electronic smoking device 300 further comprises an outer refill interface 33, comprising two separate openings 33-1, 33-2, adapted for the reception of two needle elements (not shown) of a connection interface (not shown) of a liquid container. In FIG. 11, only the first of the separate openings 33-1 is visible. The second separate opening 33-2 which is arranged next to the first separate opening 33-1 is not visible in FIG. 1. In other embodiments, the liquid reservoir of the electronic smoking device may comprise an outer refill interface comprising only one opening that is adapted for the reception of a single needle element of a connection interface of a liquid container. In this further embodiment, the outer refill interface 33 is arranged such that a line La through the two separate openings 33-1, 33-2 is perpendicular to a longitudinal center line CL of the electronic smoking device 10. However, the refill interface 33 can also be arranged such that a line through the two separate openings is parallel to a longitudinal center line CL of the electronic smoking device 10 or such that it has another orientation which is different from the one shown in FIG. 11.

Via the first separate opening 33-1 of the outer refill interface 33, liquid can be filled into the liquid reservoir 134 of the electronic smoking device 300, using for example a liquid container which has two hollow needle elements (not shown) which are insertable into the two separate openings 33-1, 33-2. Air that is ousted from the liquid reservoir 134 due to the liquid filled into the liquid reservoir 134 can be sucked out of the liquid reservoir 134 via the second separate opening 33-2. In this further embodiment, the electronic smoking device 300 further comprises a mouthpiece 454 with an air inhalation port 236 at the tip. The mouthpiece 454 of the embodiment shown in FIG. 11 is substantially identical to the mouthpiece 354 of the electronic smoking device 200 shown in the FIGS. 10*a* to 10*c*.

Figure 12C:
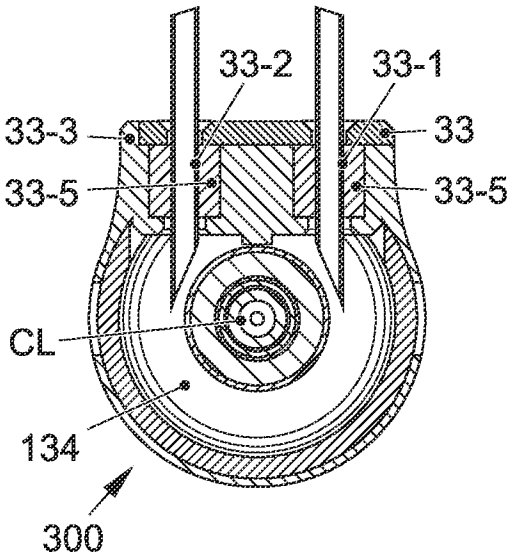
FIG. 12*c* is a schematic cross-sectional view of the further embodiment of an electronic smoking device of FIG. 11, wherein the cross-section is taken along a plane that is perpendicular to the center line of the electronic smoking device.
Figure 12B:
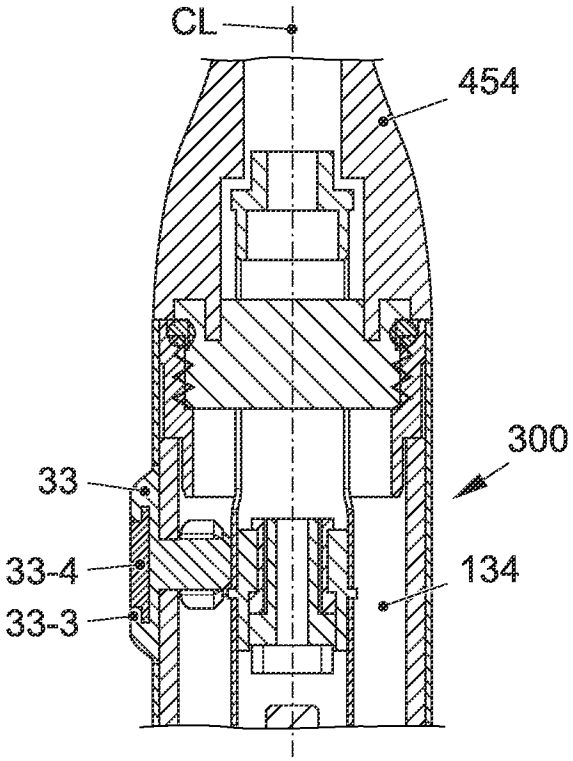
FIG. 12*b* is a schematic cross-sectional view of the further embodiment of an electronic smoking device of FIG. 11, wherein the cross-section is taken along the center line of the electronic smoking device.
Figure 12A:
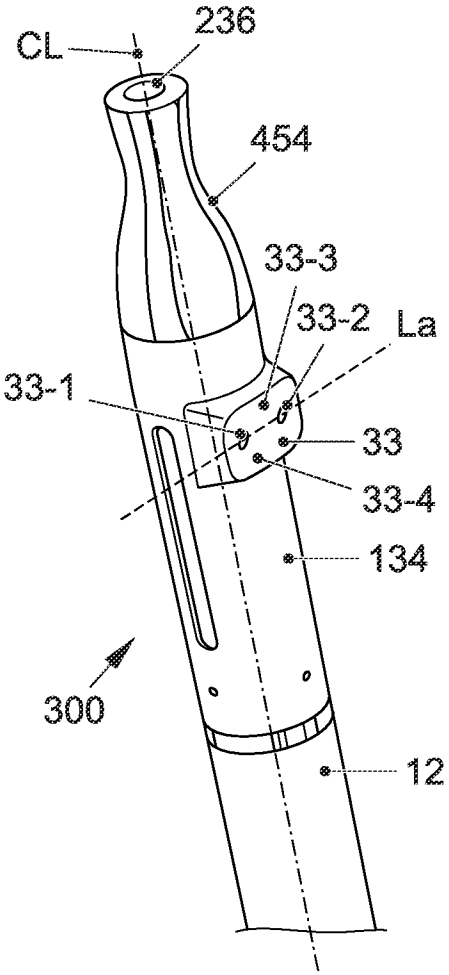
FIG. 12*a* is a perspective view of the further embodiment of an electronic smoking device of FIG. 11.

In FIG. 12*a*, the embodiment of an electronic smoking device 300 illustrated in FIG. 11 is shown in a perspective view. In the perspective shown in FIG. 12*a*, the outer refill interface 33 with the two separate openings 33-1, 33-2 therein is clearly visible. The outer refill interface 33 has a trapezoid shape and comprises a frame 33-3 on an outer front side of the same, the frame 33-3 being adapted to receive a cover plate 33-4 which is fitting into the frame 33-3. The cover plate 33-4 can be slid into the frame 33-3 in order to fully or in part cover up the two separate openings 33-1, 33-2 of the outer refill interface 33. Thus,—in some embodiments—for a refill of the liquid reservoir 134 of the electronic smoking device 300, the cover plate 33-4 at first needs to be slid out of the frame 33-3. However, in this embodiment, the cover plate 33-4 serves to fix sealings 33-5 (see FIG. 12*c*) within the two separate openings 33-1, 33-2 of the outer refill interface 33 respectively which will be described with respect to FIGS. 12*c*, 13 and 14*a* to 14*d* hereinafter. FIG. 12*b* shows a cross-section through the center line CL of the electronic smoking device 300 shown in FIGS. 11 and 12*a*. When the cover plate 33-4 is inserted into the frame 33-3, sealings 33-5 which are inserted into the separate openings 33-1, 33-2 of the outer refill interface 33 are fixed therein. Moreover, the cover plate 33-4 comprises holes which are aligned with the separate openings 33-1, 33-2 of the outer refill interface 33 and allow for hollow needle elements of a liquid container to be inserted into the separate openings 33-1, 33-2 respectively, piercing the sealings 33-5 arranged within the separate openings 33-1, 33-2 respectively.

In FIG. 12*c*, it is shown a cross-section through the electronic smoking device 300 as shown in the FIGS. 11, 12*a* and 12*b*, the cross-section being taken along a plane which is perpendicular to the center line CL of the electronic smoking device 300. In FIG. 12*c*, the cover plate 33-4 is inserted into the frame 33-3, holding the sealings 33-5 in place and allowing for the two hollow needle elements of a liquid container to be inserted into the separate openings 33-1, 33-2 of the outer refill interface 33 of the liquid reservoir 134 of the electronic smoking device 300 in order to refill the same with an e-cigarette liquid. Expressed in other words, even though they can be omitted, in some embodiments, the first and the second separate opening 33-1, 33-2 of the outer refill interface 33 further comprise a sealing 33-5 respectively. The sealing 33-5 is inserted into the first and the second separate opening 33-1, 33-2 respectively in order to seal the separate openings 33-1, 33-2 against a spilling of liquid.

Figure 13:
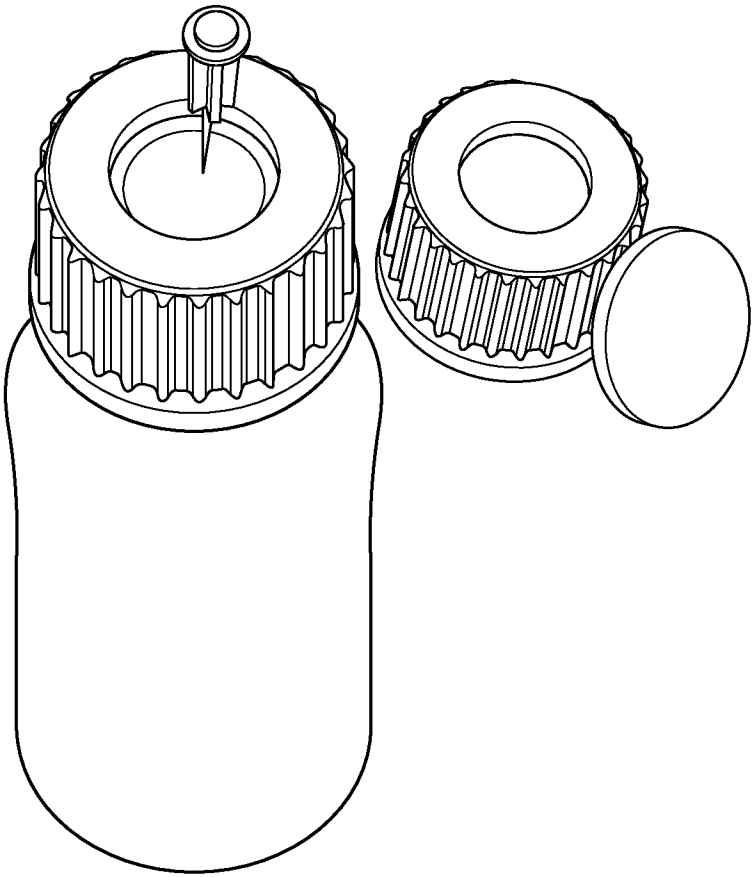
FIG. 13 is a perspective view of a silicone sealing used for the sealing of a squeezable refill bottle, illustrated for the purpose of a better understanding of silicone sealings.

In some embodiments, sealings are used which comprise silicone. Such a silicone sealing is illustrated in FIG. 13 for the purpose of a better understanding, where the nib of a liquid container realized as a squeezable refill bottle is sealed via a silicone sealing. In FIG. 13, the silicone sealing of the squeezable refill bottle is pierced by a hollow needle to illustrate the functional principle of the sealing. Such sealings are leak-safe which is due the so called skim-off-effect. Furthermore, such sealings are cost-efficient and independent from the pressure given within the sealed object.

Figure 14B:
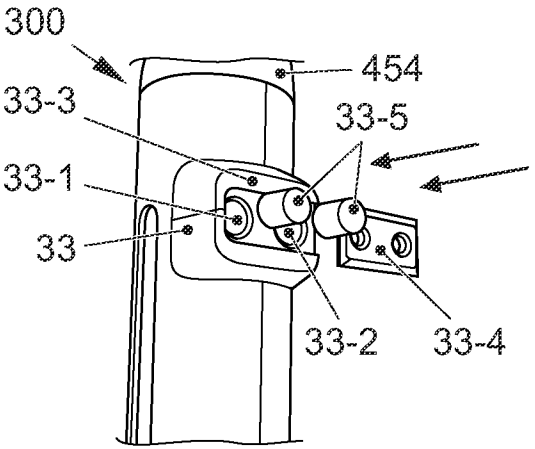
FIG. 14*b* is a perspective illustration of the second step of an insertion procedure for the insertion of cylindrical sealings into the separate openings of the outer refill interface of the further embodiment of an electronic smoking device of FIG. 11.
Figure 14A:
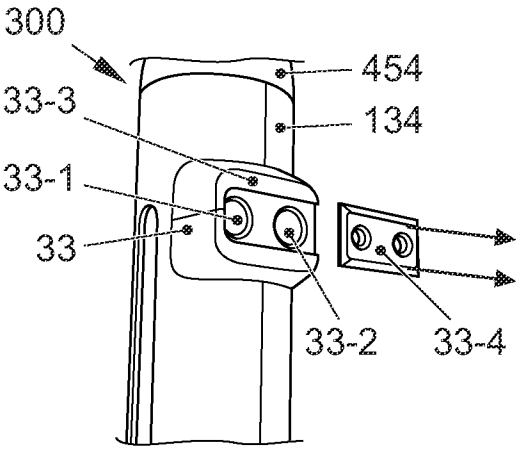
FIG. 14*a* is a perspective illustration of the first step of an insertion procedure for the insertion of cylindrical sealings into the separate openings of the outer refill interface of the further embodiment of an electronic smoking device of FIG. 11.
Figure 14D:
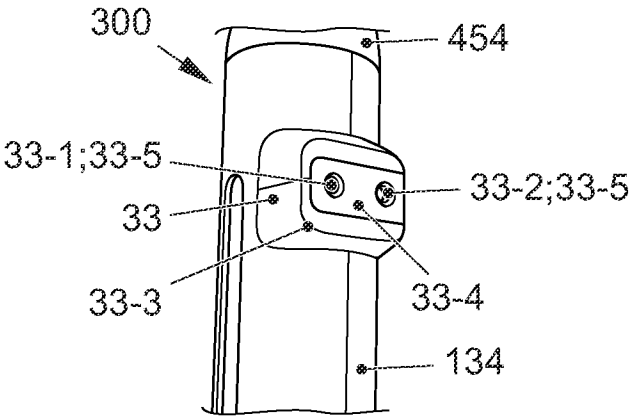
FIG. 14*d* is a perspective illustration of the fourth step of an insertion procedure for the insertion of cylindrical sealings into the separate openings of the outer refill interface of the further embodiment of an electronic smoking device of FIG. 11.
Figure 14C:
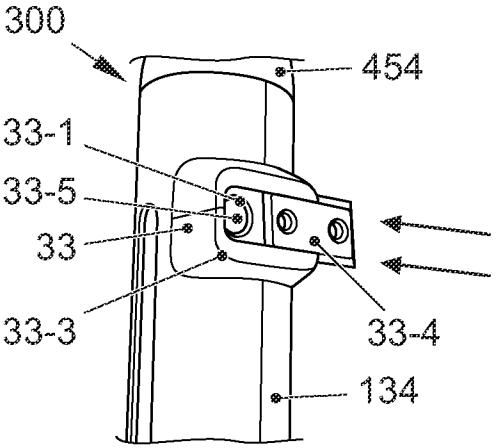
FIG. 14*c* is a perspective illustration of the third step of an insertion procedure for the insertion of cylindrical sealings into the separate openings of the outer refill interface of the further embodiment of an electronic smoking device of FIG. 11

Throughout the FIGS. 14*a* to 14*d*, the insertion of circular sealings 33-5 into the separate openings 33-1, 33-2 of the outer refill interface 33 is shown. In FIG. 14*a*, the cover plate 33-4 is slid out of the frame 33-3 of the outer refill interface 33, which in FIG. 14*a* is indicated via two arrows. In FIG. 14*b*, two cylindrically-shaped silicone sealings 33-5 are inserted into the separate openings 33-1, 33-2 of the outer refill interface 33, wherein one sealing 33-5 is provided per opening 33-1, 33-2 respectively. Also the insertion of the sealings 33-5 is indicated via two arrows in FIG. 14*b*. When the sealings 33-5 are arranged in place, the cover plate 33-4 can be slid back into the frame 33-3 of the outer refill interface 33, which is indicated in FIG. 14*c* via two arrows. In FIG. 14*d*, the cover plate 33-4 is shown in a fully inserted state with the openings of the cover plate 33-4 being aligned with the separate openings 33-1, 33-2 of the outer refill interface 33 respectively. In this state, the electronic smoking device 300 is ready to be refilled by a liquid container comprising two needle elements.

In the embodiment shown in the FIGS. 11 to 14*d*, silicone sealings 33-5 come to use. However, any other type of sealing can come to use in a separate opening of the refill interface of the liquid reservoir of an electronic smoking device respectively. Furthermore, it is also possible to realize electronic smoking devices with an outer refill interface 33 that does not comprise or use sealings. For example, it is possible to realize an electronic smoking device which comprises valves instead of sealings, especially instead of silicone sealings. For example, it is possible to realize an electronic smoking device with an outer refill interface 33 that comprises duckbill valves which are arranged within the separate openings 33-1, 33-2 of the outer refill interface 33. Furthermore, it is also possible to realize an electronic smoking device with an outer refill interface 33 that comprises check valves, especially ball valves which are arranged within the separate openings 33-1, 33-2 of the outer refill interface 33. However, also any other type of valve can come to use. Furthermore, it is also possible to realize an electronic smoking device with an outer refill interface 33 that does not comprise a sealing, a valve or the like.

In summary, in one aspect the electronic smoking device has a power supply portion comprising a power supply, and an atomizer/liquid reservoir portion comprising a refillable liquid reservoir adapted for storing a liquid, and an atomizer operable when connected to the power supply to atomize liquid stored in the liquid reservoir. The atomizer/liquid reservoir portion comprises a liquid filling channel and an air outlet channel at least partially separate from the liquid filling channel. The liquid filling channel communicates with the liquid reservoir and is configured to let pass liquid received from outside the electronic smoking device into the liquid reservoir. The air outlet channel communicates with the liquid reservoir and is configured to let pass air out of the liquid reservoir, e.g. in case of overpressure inside the liquid reservoir, when the liquid reservoir is filled with liquid.

According to an embodiment, the electronic cigarette comprises a vapor channel that is configured, when the electronic cigarette is in operation, to let atomized liquid pass towards an air inhalation port. The vapor channel is separated from the liquid filling channel.

According to an embodiment, the electronic smoking device further comprises a check valve communicating with the liquid filling channel, The check valve is configured to let pass liquid received from the outside of the electronic smoking device through the liquid filling channel to the liquid reservoir and to prevent liquid from leaking form the liquid reservoir through the liquid filling channel. The check valve can be formed as an umbrella valve, a duck bill valve, a ball valve, and the like.

According to an embodiment, the electronic smoking device further includes a vent communicating with the air outlet channel. The vent is configured to let pass air from the liquid reservoir through the air outlet channel and to prevent liquid from leaking from the liquid reservoir through the air outlet channel. The vent can be formed by a suitable membrane that is permeable to air but not permeable to liquid.

According to an embodiment, the atomizer/liquid reservoir portion comprises a liquid container coupling portion that is configured to engage with a respective coupling portion of a liquid container so as to couple the liquid container with the atomizer/liquid reservoir portion, in order to refill the liquid reservoir with liquid stored in the liquid container. The liquid container coupling portion can form part of a screw joint, a bayonet fitting, a plug connection, and the like.

According to an embodiment, the liquid filling channel is configured to communicate with a liquid outlet opening of a liquid container when the liquid container is coupled to the atomizer/liquid reservoir portion.

According to an embodiment, the air outlet channel is configured to communicate with an air inlet opening of a liquid container when the liquid container is coupled to the atomizer/liquid reservoir portion.

According to an embodiment, the electronic smoking device further comprises a first valve element that is configured, in a closed state, to prevent liquid from leaking from the liquid reservoir through the liquid filling channel, and, in an open state, to let pass liquid from the outside of the electronic smoking device through the liquid filling channel to the liquid reservoir. The first valve element is configured to be in a closed state when no liquid container is coupled to the atomizer/liquid reservoir portion and to be shifted to an open state by coupling a liquid container to the atomizer/liquid reservoir portion.

According to an embodiment, the electronic smoking device further comprises a second valve element that is configured, in a closed state, to prevent liquid from leaking from the liquid reservoir through the air outlet channel, and, in an open state, to let pass air form the liquid reservoir through the air outlet channel. The second valve element is configured to be in a closed state when no liquid container is coupled to the atomizer/liquid reservoir portion and to be shifted to an open state by coupling a liquid container to the atomizer/liquid reservoir portion.

According to an embodiment, the electronic smoking the first valve element and the second valve element are integrally formed in a common valve element.

According to an embodiment, the first valve element and/or the second valve element and/or the common valve element are configured to be shifted from a closed state to an open state by being displaced against a preload by means of a contacting element of a liquid container when the liquid container is coupled to the atomizer/liquid reservoir portion.

According to an embodiment, the atomizer/liquid reservoir portion has a multi-piece structure including a base portion comprising the atomizer and the liquid reservoir, and a refill adapter portion removably coupleable with the base portion. At least a part of the liquid filling channel and at least a part of the air outlet channel extend through the refill adapter portion. The refill adapter portion includes a liquid container coupling portion.

According to an embodiment, the electronic smoking device further comprising a mouthpiece configured to be coupled to a mouthpiece coupling portion of the atomizer/liquid reservoir portion. According to an embodiment, the liquid filling channel and the mouthpiece are configured so that liquid is prevented from leaking from the liquid reservoir through the liquid filling channel in a state in which the mouthpiece is coupled to the atomizer/liquid reservoir portion.

Analogously, the air outlet channel and the mouthpiece can be configured so that liquid is prevented from leaking from the liquid reservoir through the air outlet channel in a state in which the mouthpiece is coupled to the atomizer/liquid reservoir portion.

According to an embodiment, the refill adapter portion includes a mouthpiece coupling portion and the mouthpiece is configured to be coupled to a mouthpiece coupling portion of the refill adapter portion. The mouthpiece coupling portion can be configured to also serve as liquid container coupling portion.

According to an alternative embodiment, the base portion includes a mouthpiece coupling portion and the mouthpiece is configured to be coupled to the mouthpiece coupling portion of the base portion in a state in which the refill adapter portion is removed from the base portion. The mouthpiece coupling portion can be configured to also serve as refill adapter coupling portion for coupling the refill adapter to the base portion.

According to an embodiment, the atomizer/liquid reservoir portion has a cylindrical shape extending along a longitudinal direction of the electronic smoking device. A first end side of the cylinder faces the power supply portion and the liquid container coupling portion faces a second side opposite to the first side. The liquid filling channel and/or the air outlet channel preferably include an opening facing the second side.

The above described embodiments can generally be combined in any manner, as long as no obvious inconsistencies would result from such a combination.

According to a second aspect, an atomizer/liquid reservoir portion for an electronic cigarette comprises a refillable liquid reservoir adapted for storing a liquid, and an atomizer operable when connected to a power supply of the electronic cigarette to atomize liquid stored in the liquid reservoir. The atomizer/liquid reservoir portion comprises a liquid filling channel and an air outlet channel at least partially separate from the liquid filling channel. The liquid filling channel communicates with the liquid reservoir and is configured to let pass liquid received from outside the electronic smoking device into the liquid reservoir. The air outlet channel communicates with the liquid reservoir and is configured to let pass air out of the liquid reservoir.

Preferred embodiments of the atomizer/liquid reservoir portion have already been described above with respect to the electronic smoking device according to the first aspect.

According to a third aspect, a system is provided including an electronic cigarette according to the first aspect, wherein the atomizer/liquid reservoir portion comprises a liquid container coupling portion that is configured to engage with a respective coupling portion of a liquid container so as to couple the liquid container with the atomizer/liquid reservoir portion, and a liquid container configured to be coupled to the liquid container coupling portion.

According to a fourth aspect, a refill adapter portion is provided, the refill adapter portion being configured to be removably coupled to a base portion of an atomizer liquid reservoir portion of an electronic smoking device. The base portion includes a liquid reservoir and an atomizer as described above with respect to the second aspect. The refill adapter portion comprises a liquid filling channel and an air outlet channel at least partially separate from the liquid filling channel. The liquid filling channel is configured to communicate with the liquid reservoir and to let pass liquid received from outside the electronic smoking device into the liquid reservoir when the refill adapter portion is coupled to the base portion. The air outlet channel is configured to communicate with the liquid reservoir and to let pass air out of the liquid reservoir when the refill adapter portion is coupled to the base portion.

According to a fifth aspect, a liquid container is provided, the liquid container comprising a first contacting portion adapted to be connected to a liquid filling channel of an electronic smoking device and to fill the electronic smoking device with liquid contained within the liquid container via the first contacting portion. Furthermore, the liquid container comprises a second contacting portion adapted to be connected to an air outlet channel of an electronic smoking device and to suck air ousted out of the electronic smoking device into the liquid container. Furthermore, the liquid container comprises a first blocking element adapted to prevent liquid contained within the liquid container to be expelled via the first contacting portion when the liquid container is not connected to an electronic smoking device and/or to allow for liquid contained within the liquid container to be expelled via the first contacting portion when the liquid container is connected to an electronic smoking device.

Preferably, the liquid container further comprises a second blocking element, adapted to prevent a fluid from inside of the liquid container to be expelled via the second contacting portion and to allow a fluid from outside of the liquid container to enter the inner volume of the liquid container.

In a preferred embodiment of the liquid container, the second blocking element is a check valve.

In an even more preferred embodiment of the liquid container, the second blocking element is a duckbill valve.

Preferably, the first blocking element comprises a spring-loaded connection component which protrudes from an inside of the liquid container to an outside of the liquid container.

Preferred embodiments of the refill adapter portion have already been described above with respect to the atomizer/liquid reservoir portion according to the second aspect.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

10, 100, 200, 300 electronic smoking device
12 power supply portion
14 atomizer/liquid reservoir portion
16 end cap
18 battery
20 light-emitting diode (LED)
22 control electronics
24 airflow sensor
26 atomizer
28 heating coil
30 wick
32, 132 central passage
33 outer refill interface
33-1 first opening of outer refill interface
33-2 second opening of outer refill interface
33-3 frame on outer refill interface
33-4 cover plate
33-5 sealing
34, 134 liquid reservoir
36, 136, 236 air inhalation port
38 air inlets
40, 140, 240 liquid filling channel
41 chamber
42, 142, 242 air outlet channel
44, 144, 244 check valve
46 vent
48, 148, 248 vapor channel
50, 150 base portion
52, 152, 252, 352, 452, 552, 652 refill adapter portion
54, 154, 254, 354, 454 mouthpiece
56 refill adapter coupling portion
58, 158, 258, 358 mouthpiece coupling portion
60, 160, 260, 360, 460 liquid container coupling portion
62 contacting element
64 valve element
66, 166, 266 spring
67 coupling portion of liquid container
67-1 first blocking element
67-2 pin
67-3 opening within the coupling portion
67-4 spring within the coupling portion
67-5 internal collar
67-6 hollow tube element
67-7 second blocking element
68, 168, 268, 368, 468, 568 liquid container
69 bottle neck
70, 170, 270, 370 liquid outlet opening
71 refill hole
72, 172, 372 air inlet opening
74 duck bill valve
80, 180, 280 first valve element
82, 182 second valve element
84, 184, 86, 186, 286 contacting portion
88 common valve element
89 edge
90 pin
91 edge
L liquid flow direction
La line
A air flow direction
$P_1$, $P_2$ dislocation directions
$R_1$ inserting direction
$R_2$ opposite direction to inserting direction
$S_1$, $S_2$ first side, second side opposite to first side
CL center line of electronic smoking device

The invention claimed is:

1. An electronic smoking device comprising:

a power supply, and an atomizer/liquid reservoir portion comprising a refillable liquid reservoir, and an atomizer configured to atomize a liquid stored in the liquid reservoir, wherein the atomizer/liquid reservoir portion further comprises a liquid filling channel, an aerosol channel, and an air outlet channel, wherein the air outlet channel is at least partially separate from the liquid filling channel and the aerosol channel, wherein the liquid filling channel is configured to pass liquid into the liquid reservoir, wherein the atomizer/liquid reservoir portion comprises a coupling portion that is configured to engage with a liquid container, and wherein the air outlet channel communicates with the liquid reservoir and is configured to let pass air out of the liquid reservoir;

a first valve element that is configured, in a closed state, to prevent liquid from leaking from the liquid reservoir through the liquid filling channel, and, in an open state, to let pass liquid from the outside of the electronic smoking device through the liquid filling channel to the liquid reservoir;

a second valve element that is configured, in a closed state, to prevent liquid from leaking from the liquid reservoir through the air outlet channel, and, in an open state, to let pass air form the liquid reservoir through the air outlet channel, wherein the second valve element is configured to be shifted to an open state by coupling a liquid container to the atomizer/liquid reservoir portion.

2. The electronic smoking device according to claim 1, further comprising a check valve communicating with the liquid filling channel and configured to let pass liquid received from the outside of the electronic smoking device through the liquid filling channel to the liquid reservoir and to prevent liquid from leaking form the liquid reservoir through the liquid filling channel.

3. The electronic smoking device according to claim 2, further including a vent communicating with the air outlet channel and configured to let pass air from the liquid reservoir through the air outlet channel and to prevent liquid from leaking from the liquid reservoir through the air outlet channel.

4. The electronic smoking device according to claim 1, further including a vent communicating with the air outlet channel and configured to let pass air from the liquid reservoir through the air outlet channel and to prevent liquid from leaking from the liquid reservoir through the air outlet channel.

5. The electronic smoking device according to claim 1, wherein the liquid filling channel is configured to communicate with a liquid outlet opening of the liquid container when the liquid container is coupled to the atomizer/liquid reservoir portion, and/or wherein the air outlet channel is configured to communicate with an air inlet opening of the liquid container when the liquid container is coupled to the atomizer/liquid reservoir portion.

6. The electronic smoking device according to claim 1, wherein the first valve element and/or the second valve element are configured to be shifted from a closed state to an open state by being displaced against a preload by means of a contacting element of the liquid container when the liquid container is coupled to the atomizer/liquid reservoir portion.

7. The electronic smoking device according to claim 1, wherein the atomizer/liquid reservoir portion has a multipiece structure including a base portion comprising the atomizer and the liquid reservoir, and a refill adapter portion removably coupleable with the base portion, wherein at least a part of the liquid filling channel and at least a part of the air outlet channel extend through the refill adapter portion and wherein the refill adapter portion includes the coupling portion.

8. The electronic smoking device according to claim 7, wherein the refill adapter portion includes a mouthpiece coupling portion and a mouthpiece is configured to be coupled to the mouthpiece coupling portion of the refill adapter portion, wherein the mouthpiece coupling portion is configured to also serve as coupling portion.

9. The electronic smoking device according to claim 7, wherein the base portion includes a mouthpiece coupling portion and a mouthpiece is configured to be coupled to the mouthpiece coupling portion of the base portion in a state in which the refill adapter portion is removed from the base portion, wherein the mouthpiece coupling portion is configured to also serve as refill adapter coupling portion for coupling the refill adapter to the base portion.

10. The electronic smoking device according to claim 1 further comprising a mouthpiece configured to be coupled to the atomizer/liquid reservoir portion, wherein the liquid filling channel and the mouthpiece are configured so that liquid is prevented from leaking from the liquid reservoir through the liquid filling channel in a state in which the mouthpiece is coupled to the atomizer/liquid reservoir portion, and/or wherein the air outlet channel and the mouthpiece are configured so that liquid is prevented from leaking from the liquid reservoir through the air outlet channel in a state in which the mouthpiece is coupled to the atomizer/liquid reservoir portion.

11. The electronic cigarette according to claim 1, wherein the atomizer/liquid reservoir portion has a cylindrical shape extending along a longitudinal direction of the electronic smoking device, wherein a first end side of the cylinder faces the power supply and wherein the coupling portion faces a second side opposite to the first side, wherein the liquid filling channel and/or the air outlet channel comprise an opening facing the second side.

12. An atomizer/liquid reservoir portion for an electronic cigarette comprising:

a refillable liquid reservoir adapted for storing a liquid, and an atomizer configured to atomize liquid stored in the liquid reservoir, wherein the atomizer/liquid reservoir portion further comprises a liquid filling channel, an aerosol channel, and an air outlet channel, wherein the aerosol channel is configured to direct the atomized liquid from the atomizer to an exterior portion of the electronic cigarette, wherein the air outlet channel is at least partially separate from the liquid filling channel and the aerosol channel, wherein the liquid filling channel is configured to let liquid received from outside the electronic cigarette-into the liquid reservoir, and wherein the air outlet channel is configured to let pass air out of the liquid reservoir a first valve element that is configured, in a closed state, to prevent liquid from leaking from the liquid reservoir through the liquid filling channel, and, in an open state, to let pass liquid from the outside of the electronic cigarette through the liquid filling channel to the liquid reservoir, wherein the first valve element is configured to be shifted to an open state by coupling a liquid container to the atomizer/liquid reservoir portion;

a second valve element that is configured, in a closed state, to prevent liquid from leaking from the liquid reservoir through the air outlet channel, and, in an open state, to let pass air form the liquid reservoir through the air outlet channel, wherein the second valve element is configured to be shifted to an open state by coupling a liquid container to the atomizer/liquid reservoir portion.

13. The electronic smoking device according to claim 12, wherein the refill adapter portion includes a mouthpiece coupling portion and a mouthpiece is configured to be coupled to the mouthpiece coupling portion of the refill adapter portion, wherein the mouthpiece coupling portion is configured to also serve as coupling portion.

14. The electronic smoking device according to claim 12, wherein the base portion includes a mouthpiece coupling portion and a mouthpiece is configured to be coupled to the mouthpiece coupling portion of the base portion in a state in which the refill adapter portion is removed from the base portion, wherein the mouthpiece coupling portion is configured to also serve as refill adapter coupling portion for coupling the refill adapter to the base portion.

15. The electronic smoking device according to claim 12, further including a vent communicating with the air outlet channel and configured to let pass air from the liquid reservoir through the air outlet channel and to prevent liquid from leaking from the liquid reservoir through the air outlet channel.

* * * * *